US006644261B2

(12) United States Patent
Morii et al.

(10) Patent No.: US 6,644,261 B2
(45) Date of Patent: Nov. 11, 2003

(54) COOLING ARRANGEMENT FOR A SNOWMOBILE ENGINE

(75) Inventors: Hideshi Morii, Hamamatsu (JP); Yasuaki Yatagai, Hamamatsu (JP); Yutaka Sasaki, Hamamatsu (JP); Ken Shibano, Hamamatsu (JP); Hitoshi Matsumura, Hamamatsu (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 0 days.

(21) Appl. No.: 10/167,506

(22) Filed: Jun. 13, 2002

(65) Prior Publication Data

US 2002/0189556 A1 Dec. 19, 2002

(30) Foreign Application Priority Data

Jun. 15, 2001 (JP) ..... 2001-181797

(51) Int. Cl.[7] ..... F02F 7/00

(52) U.S. Cl. ..... 123/195 R; 123/41.1; 123/41.44; 180/68.4

(58) Field of Search ..... 123/41.1, 41.44, 123/41.47, 195 R; 180/68.4, 190

(56) References Cited

U.S. PATENT DOCUMENTS 5,992,552 A * 11/1999 Eto ..... 180/68.4

FOREIGN PATENT DOCUMENTS

| | | |
|---|---|---|
| JP | 2001-12243 A | 1/2001 |
| JP | 2001-65344 A | 3/2001 |
| JP | 2001-98940 A | 4/2001 |
| JP | 2001-99021 A | 4/2001 |

* cited by examiner

*Primary Examiner*—Noah P. Kamen
(74) *Attorney, Agent, or Firm*—Nixon & Vanderhye, P.C.

(57) ABSTRACT

In a cooling arrangement for a water-cooled snowmobile engine, a water pump is disposed on the front side of the cylinder head, under the exhaust manifold and is coupled to a crankshaft so that it is driven by the rotational force which is transmitted through a drive belt from a drive pulley fitted on the crankshaft end. A cooling water inlet port for leading cooling water into the interior of the engine is provided on the front side of the cylinder block and under the exhaust manifold while a cooling water outlet port through which cooling water is taken out from the interior of the engine is arranged on the cylinder head's side face at a position over and opposite to the drive belt and a thermostat is arranged at the cooling water outlet port.

15 Claims, 18 Drawing Sheets

COOLING ARRANGEMENT FOR A SNOWMOBILE ENGINE

BACKGROUND OF THE INVENTION (1) Field of the Invention

The present invention relates to a structure of a water-cooled engine, in particular relates to a snowmobile engine cooling arrangement having cooling water passages for cooling a snowmobile engine.

(2) Description of the Prior Art

Conventionally, most small snow vehicle such as snowmobiles and the like use two-cycle engines because they are relatively simple in structure, light and compact and yet powerful. Recently, however, because of regulation of exhaust gas due to environmental issues and aiming at improvement in reduction of fuel consumption rate, there is a trend toward employing four-cycle engines.

As the engine structure for snowmobiles, water-cooled engines have been generally employed because they can stably cool the engine by cooling water, preventing the occurrence of overheating or overcooling and improving the output power and yet are effective in reducing noise.

As an example of conventional engine cooling arrangements, Japanese Patent Application Laid-Open No. 2001-12243 discloses a cooling system for a snowmobile engine. This cooling system is comprised of a cooling water jacket formed inside the engine, a heat exchanger for cooling the cooling water and a cooling water pump for transferring the cooling water so as to circulate the cooling water inside the engine, and further includes: a cooling water bypass through which the cooling water can pass, avoiding its flow into the heat exchanger; and a switching valve for permitting the cooling water to flow into the cooling water bypass, wherein the switching valve is adapted to switch the cooling water circuit in such a manner that the cooling water is allowed to pass through the heat exchanger when the cooling water is equal to or higher in temperature than a predetermined level, and the cooling water is restricted from passing through the heat exchanger and is conducted to the cooling water bypass when the temperature of the cooling water is lower than the predetermined temperature level.

Meanwhile, in contrast to two-cycle engines, which are high in power, light and compact, four-cycle engines need a camshaft and oil lubrication, inevitably tending towards large size.

In particular, when a four-cycle engine is included in a snowmobile, it is necessary to provide a contrived layout of the oil pan configuration, intake and exhaust systems and associated auxiliaries, in order to make the body and engine hood have similar size to those of a two-cycle engine.

Further, in general, when the mounted engine is of a water cooled type, a reservoir tank should be interposed within the piping of the cooling water. That is, it is necessary to take into account the installation space for this reservoir tank. Further, the reservoir tank needs to be arranged at a site where it is easy for cooling water to be re-supplied.

Since the snowmobile is used in cold areas, in order to stabilize the idling engine speed at the start of operation or in order to regulate the surging of the thermostat, it is necessary to consider the layout of the cooling water piping and the position of the thermostat.

Further, the cooling water pump for transferring cooling water is driven by a belt which is driven by the rotation of the crankshaft. This means the enlargement of the longitudinal size of the engine. Therefore it is necessary to arrange the cooling water pump at an appropriate position. Moreover, it is necessary to choose the position of the cooling water pump optimally, considering the positional relationship with an alternator, which is belt driven, so that the front-to-rear size of the engine will be minimized.

SUMMARY OF THE INVENTION

The present invention has been devised in view of the above conventional problems, it is therefore an object of the present invention to provide a cooling arrangement for a snowmobile engine, which is able to stabilize the engine idling speed at the start of operation and is improved in the work performance in supplying cooling water and realizes a space-saving engine layout.

In order to achieve the above object, the present invention is configured as follows:

In accordance with the first aspect of the present invention, a cooling arrangement for a snowmobile engine, includes: a cooling water jacket formed inside an engine; a heat exchanger for cooling water; a water pump for ejecting cooling water; and a thermostat for controlling supply of the cooling water ejected from the water pump into the engine, so as to cool the engine by circulating the cooling water inside the engine, and is characterized in that:

the engine is mounted with its cylinder head at top, and an exhaust manifold is disposed on the front side, with respect to the vehicle's direction of travel, of the cylinder head while an intake manifold is disposed on the rear side, with respect to the vehicle's direction of travel, of the cylinder head;

the water pump is disposed on the front side, with respect to the vehicle's direction of travel, of cylinder block of the engine, under the exhaust manifold and is coupled to a crankshaft projected from one side wall, with respect to the widthwise direction of the body, of the cylinder block, so that it is driven by the rotational force which is transmitted through a drive belt from a rotational member fitted on one end of the crankshaft;

a cooling water inlet port for leading cooling water into the cooling water jacket inside the engine is provided on the front side, with respect to the vehicle's direction of travel, of the cylinder block and under the exhaust manifold at a position close to the drive belt;

a cooling water outlet port through which cooling water is taken out from the interior of the engine is arranged on the engine's side face at a position over and opposite to the drive belt; and the thermostat is arranged at the cooling water outlet port, at a point downstream with respect to the flow of cooling water.

In accordance with the second aspect of the present invention, the cooling arrangement for a snowmobile engine having the above first feature is characterized in that the cooling water outlet port is comprised of a thermo housing for incorporating the thermostat and a thermo cap for covering the thermostat, the thermo cap being connected to the heat exchanger by way of a cooling water passage.

In accordance with the third aspect of the present invention, the cooling arrangement for a snowmobile engine having the above second feature is characterized in that the thermo housing is formed with a first cooling water bypass passage which branches off at a point upstream, with respect to the flow of cooling water, of the thermostat and is connected by way of a throttle body to the cooling water passage at a point upstream of the water pump.

In accordance with the fourth aspect of the present invention, the cooling arrangement for a snowmobile engine having the above second feature is characterized in that the thermo housing is formed with a second cooling water bypass passage which branches off at a point upstream of the thermostat and is connected directly to the cooling water passage at a point upstream of the water pump without passing through the throttle body.

In accordance with the fifth aspect of the present invention, the cooling arrangement for a snowmobile engine having the above third feature is characterized in that the thermostat is used to control the outlet of cooling water after passage of the cooling water jacket inside the engine while the thermo housing side and cooling water passage side are kept so as to be in constant communication to each other through the first cooling water bypass passage and the second cooling water bypass passage.

In accordance with the sixth aspect of the present invention, the cooling arrangement for a snowmobile engine having the above fourth feature is characterized in that the thermostat is used to control the outlet of cooling water after passage of the cooling water jacket inside the engine while the thermo housing side and cooling water passage side are kept so as to be in constant communication to each other through the first cooling water bypass passage and the second cooling water bypass passage.

In accordance with the seventh aspect of the present invention, the cooling arrangement for a snowmobile engine having the above first feature is characterized in that, in the snowmobile, an oil filter is arranged on the front side, with respect to the vehicle's direction of travel, of the cylinder block and an oil cooling means is interposed between the oil filter and the cylinder block.

In accordance with the eighth aspect of the present invention, the cooling arrangement for a snowmobile engine having the above first feature is characterized in that, in the snowmobile, an oil cooling means is provided on the front side, with respect to the vehicle's direction of travel, of a crawler for causing the snowmobile to move.

In accordance with the ninth aspect of the present invention, the cooling arrangement for a snowmobile engine having the above first feature is characterized in that, in the snowmobile, a muffler is disposed in front of the engine body in the engine room and an oil cooling means is arranged in front of the muffler.

In accordance with the tenth aspect of the present invention, the cooling arrangement for a snowmobile engine having the above first feature is characterized in that the water pump is arranged between the engine and the exhaust passage provided in front of the engine.

In accordance with the eleventh aspect of the present invention, the cooling arrangement for a snowmobile engine having the above first feature is characterized in that the water pump is arranged over an oil pan.

In accordance with the twelfth aspect of the present invention, the cooling arrangement for a snowmobile engine having the above first feature is characterized in that the water pump is arranged under the exhaust manifold.

In accordance with the thirteenth aspect of the present invention, the cooling arrangement for a snowmobile engine having the above first feature is characterized in that the engine has an alternator provided at a position opposite the water pump with the cylinder block in between, the three components being laid from the front to rear with respect to the vehicle's direction of travel.

In accordance with the fourteenth aspect of the present invention, the cooling arrangement for a snowmobile engine having the above first feature is characterized in that a cooling water reservoir tank is arranged in the rear of the engine, at the side of the intake manifold, over an oil pan, heat exchanger and alternator.

In accordance with the fifteenth aspect of the present invention, the cooling arrangement for a snowmobile engine having the above first feature is characterized in that a cooling water reservoir tank is arranged without being projected outwards beyond a drive belt for driving an alternator and water pump, when viewed from top.

According to the present invention, the following effects can be obtained.

First, in a cooling arrangement for a snowmobile engine, the engine is mounted with its cylinder head at top, and an exhaust manifold is disposed on the front side, with respect to the vehicle's direction of travel, of the cylinder head while an intake manifold is disposed on the rear side, with respect to the vehicle's direction of travel, of the cylinder head. The water pump is disposed on the front side, with respect to the vehicle's direction of travel, of the cylinder head of the engine, under the exhaust manifold and is coupled to a crankshaft projected from one side wall, with respect to the widthwise direction of the body, of the cylinder block, so that it is driven by the rotational force which is transmitted through a drive belt from a rotational member fitted on one end of the crankshaft. Further, a cooling water intake port for leading cooling water into the cooling water jacket inside the engine is provided on the front side, with respect to the vehicle's direction of travel, of the cylinder block and under the exhaust manifold, at a position close to the drive belt while a cooling water outlet port through which cooling water is taken out from the interior of the engine is arranged on the engine's side face opposite to the drive belt side or on the opposite side at a position above the crankshaft from which engine power is taken. This arrangement makes it possible for the cooling water to flow through the engine interior, approximately diagonally from the bottom to the top, hence the water is able to efficiently flow and be discharged without stagnation inside the cylinder head and inside the cylinder block. Accordingly, this configuration provides an engine of an improved cooling efficiency compared to the conventional configuration. Further, since supply and discharge of cooling water is achieved utilizing the dead space near the water pump and under the exhaust manifold, this arrangement realizes an engine of a highly efficient space usage.

Since the cooling water outlet port is formed with a thermo housing incorporating a thermostat and a thermo cap covering the thermostat while the thermo cap is connected to the heat exchanger by way of a cooling water passage, e.g., a cooling water hose so as to control the cooling water at the cooling water outlet, by making a so-called outlet control, it is possible to perform correct cooling water control at a stable cooling water temperature.

Since the thermo housing is formed with a first cooling water bypass passage which branches off at a point upstream, with respect to the flow of cooling water, of the thermostat and is connected by way of a throttle body to the cooling water passage at a point upstream of the water pump, it is possible to prevent icing and make stable intake control by maintaining the cooling water supplied to the throttle valve at an approximately fixed temperature.

Since the thermo housing is formed with a second cooling water bypass passage which branches off at a point upstream, with respect to the flow of cooling water, of the thermostat and is connected directly to the cooling water passage at a point upstream, with respect to the flow of cooling water, of the water pump without passing through the throttle body, the cooling water warmed by the engine is supplied to the engine. This makes it possible to regulate the temperature of the cooling water at an approximately constant level under the thermostat control of supply of the cooling water cooled through the heat exchanger, hence realizing a good operational condition of the engine.

Since control of cooling water by the thermostat is performed by regulating the outlet of cooling water after passage of the cooling water jacket inside the engine, it is possible to make reliable cooling water control based on the cooling water of a stabilized water temperature. Further, since the thermo housing side and cooling water passage side are kept so as to be in constant communication to each other through the first cooling water bypass passage and the second cooling water bypass passage, this makes it possible to regulate the temperature of the cooling water in the engine at an approximately constant level. As a result, the thermostat for opening and closing the main cooling water passage in response to the cooling water temperature quickly reacts to the cooling water temperature that varies dependent on the operational state of the engine, to thereby prevent the occurrence of engine seizure and other troubles.

Since, in the snowmobile, an oil filter is arranged on the front side, with respect to the vehicle's direction of travel, of the cylinder block and an oil cooling means, e.g., an oil cooler, is interposed between the oil filter and the cylinder block, it is possible to efficiently cool not only the engine but also the engine oil, thus achieving a beneficial operational condition of the engine.

Since, in the snowmobile, an oil cooling means is provided on the front side, with respect to the vehicle's direction of travel, of a crawler for causing the snowmobile to move, it is possible to perform improved cooling by cooling oil with the scattered snow. Further, since two divided heat exchanging means or heat exchangers are provided, where one is used as usual for cooling water and the other for cooling oil, it is possible to realize different cooling functions with a simple structure.

Since a muffler is disposed in front of the engine body in the engine room in the snowmobile and an oil cooling means is arranged in front of the muffler, this arrangement allows the oil cooling means to receive the flow of air, during travel, ahead of the muffler and exhaust pipe which are higher in temperature than the oil cooler. Thus, it is possible to cool the oil at an improved efficiency.

Since the water pump is arranged between the engine and the exhaust passage provided in front of the engine, it is possible to realize a space-saving engine layout utilizing the dead space under the exhaust passage.

Since the water pump is arranged over an oil pan, it is possible to prevent the engine height from increasing.

Since the water pump is arranged under the exhaust manifold, it is possible to realize a space-saving engine layout utilizing the dead space under the exhaust manifold.

Since the engine has an alternator provided at a position opposite the water pump with the cylinder block in between, the three components being laid from the front to rear with respect to the vehicle's direction of travel, it is possible to realize a space-saving and well-balanced drive belt layout.

Since a cooling water reservoir tank is arranged in the rear of the engine, at the side of the intake manifold, over an oil pan, heat exchanger and alternator, this arrangement of the reservoir tank at the top of the engine room makes it easy for cooling water to be re-supplied and other maintenance.

Since a cooling water reservoir tank is arranged without being projected outwards beyond a drive belt for driving an alternator and water pump, when viewed from top, this arrangement realizes a compact engine configuration.

DESCRIPTION OF THE PREFERRED EMBODIMENTS

Figure 1:
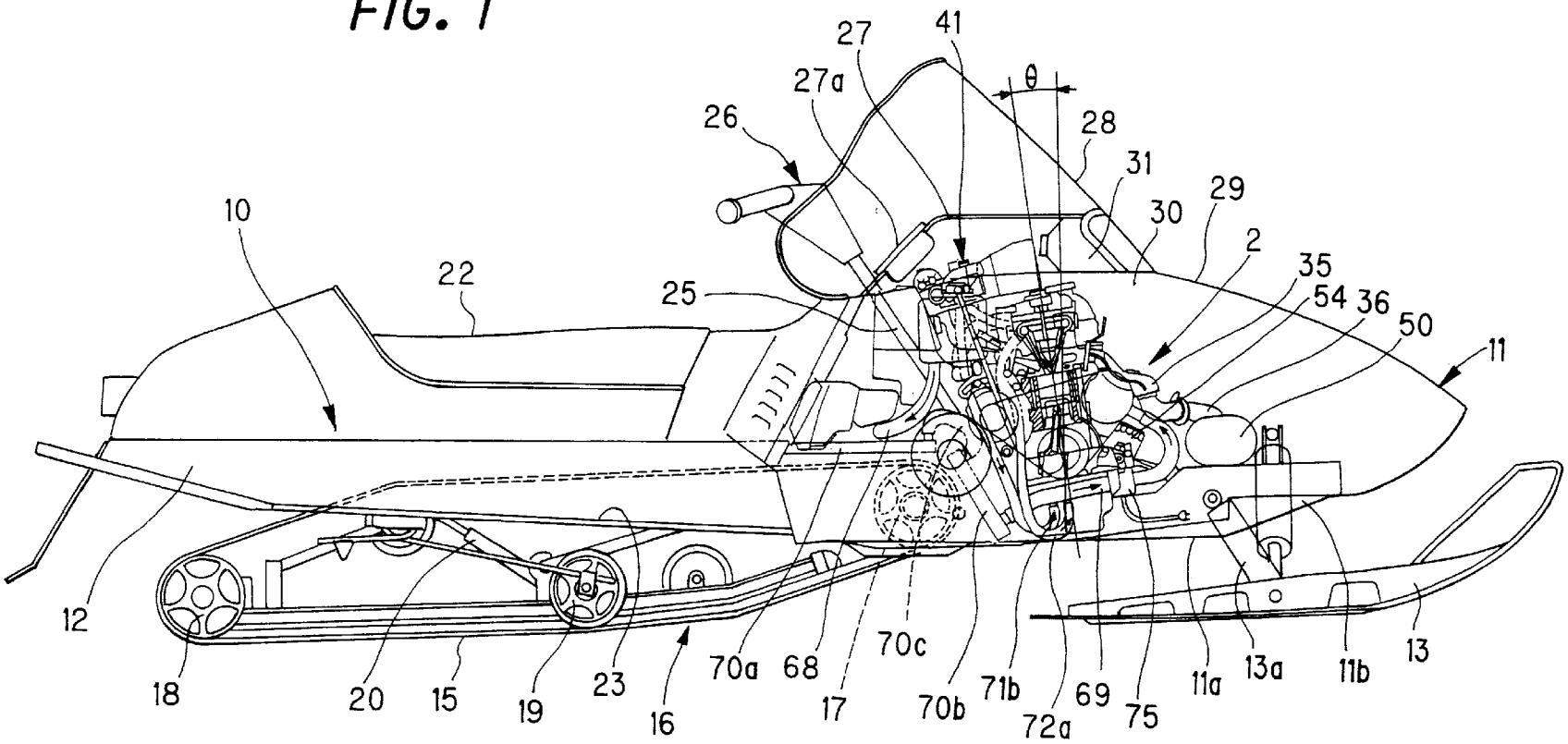
FIG. 1 is a side view showing the overall configuration of a snowmobile in accordance with the embodiment of the present invention.

The embodiments of the present invention will here in after be described in detail with reference to the accompanying drawings.

FIGS. 1 to 7 show one example of the embodiment of the present invention, and like reference numerals in the drawings represent identical components.

Figure 2:
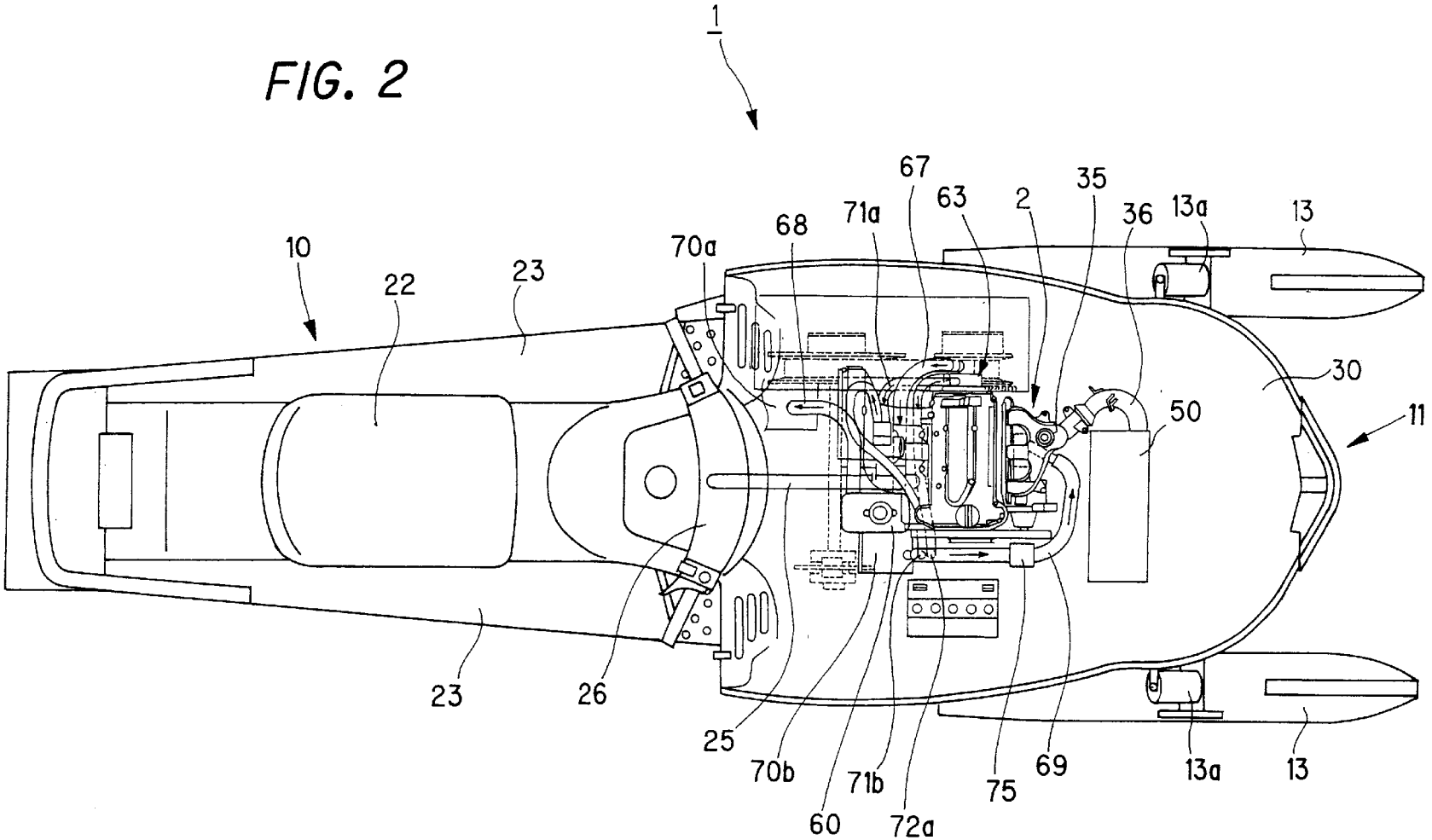
FIG. 2 is a plan view showing the overall configuration of the snowmobile.
Figure 3:
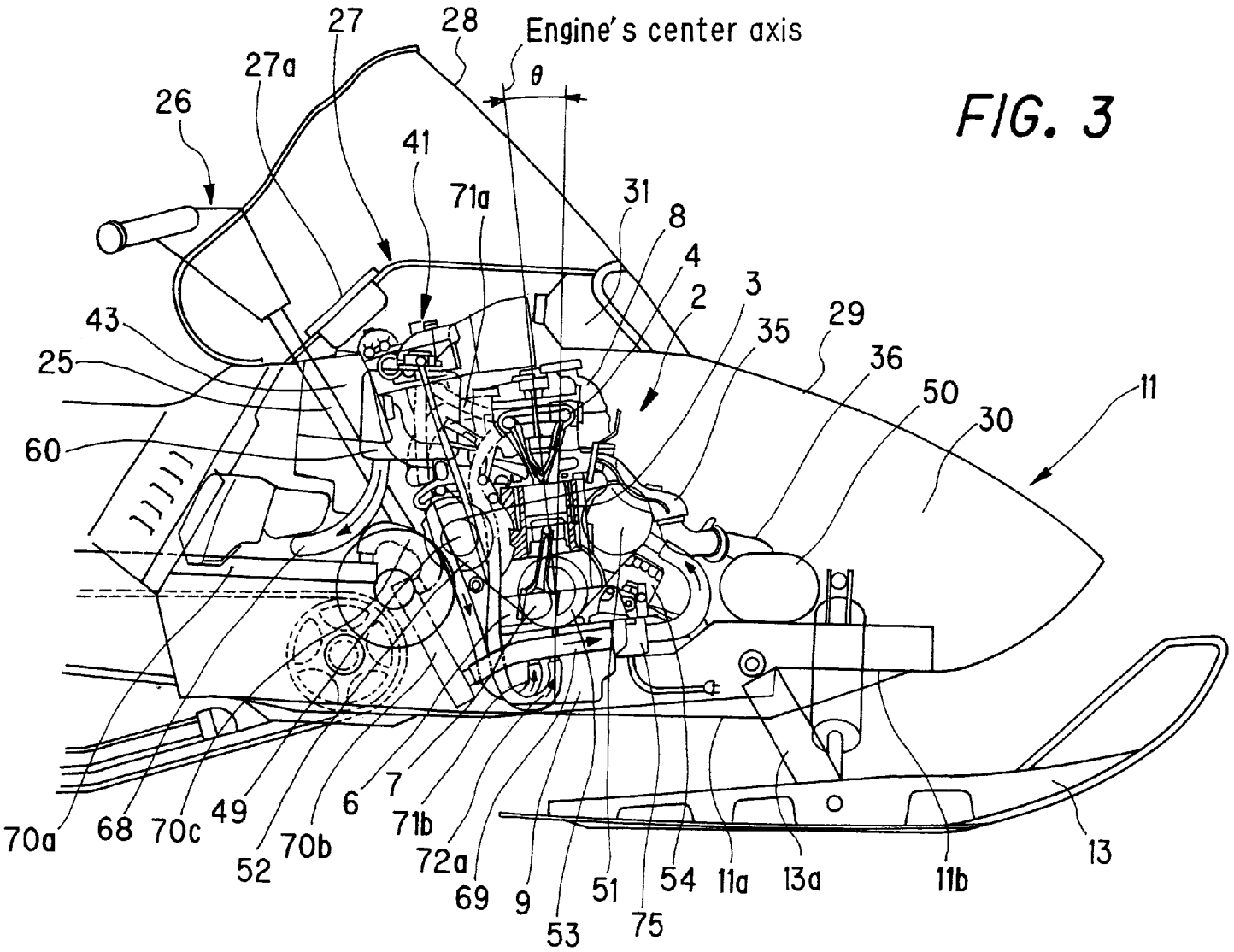
FIG. 3 is a side view showing an engine layout in the engine room.
Figure 4:
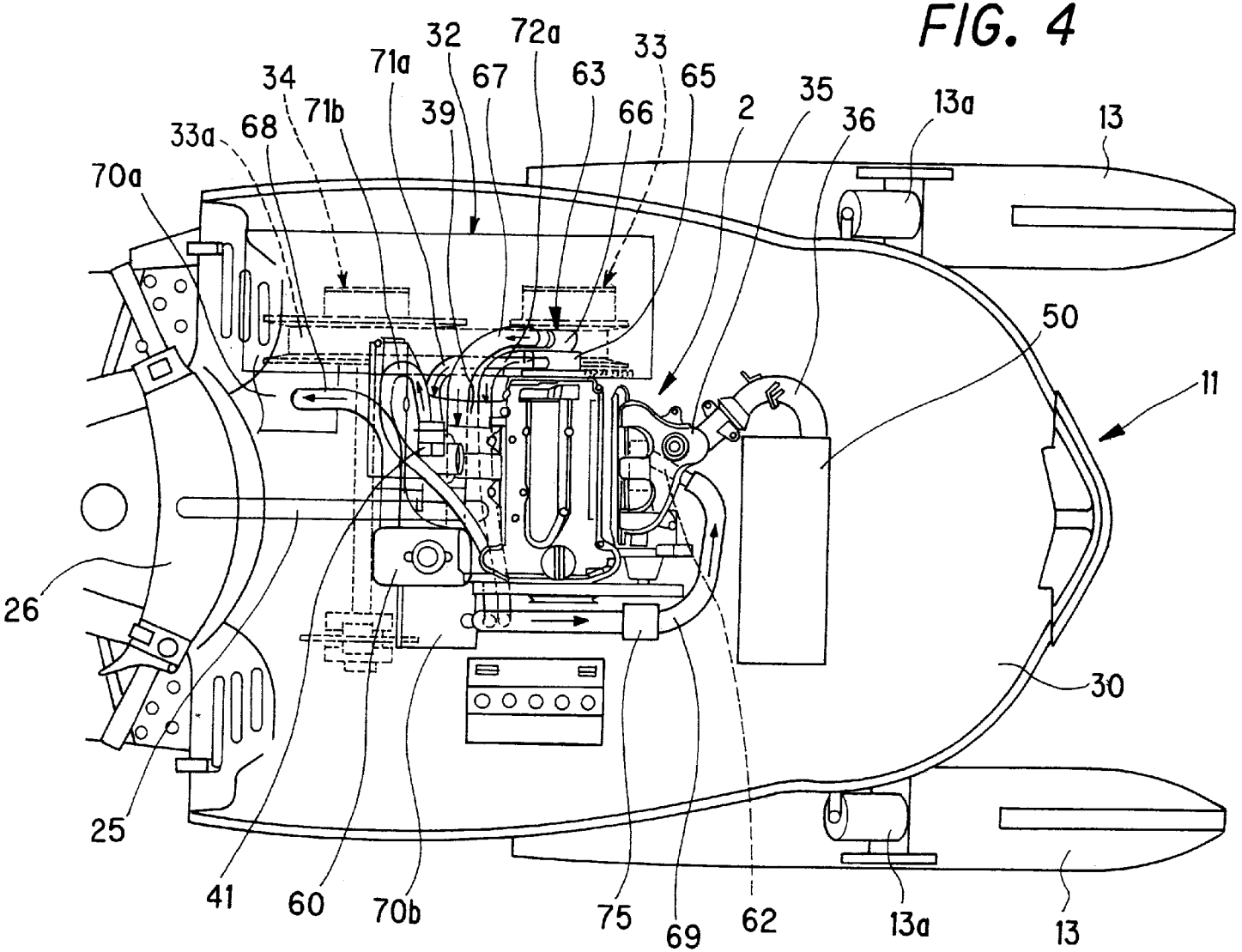
FIG. 4 is a plan view showing an engine layout in the engine room.
Figure 5:
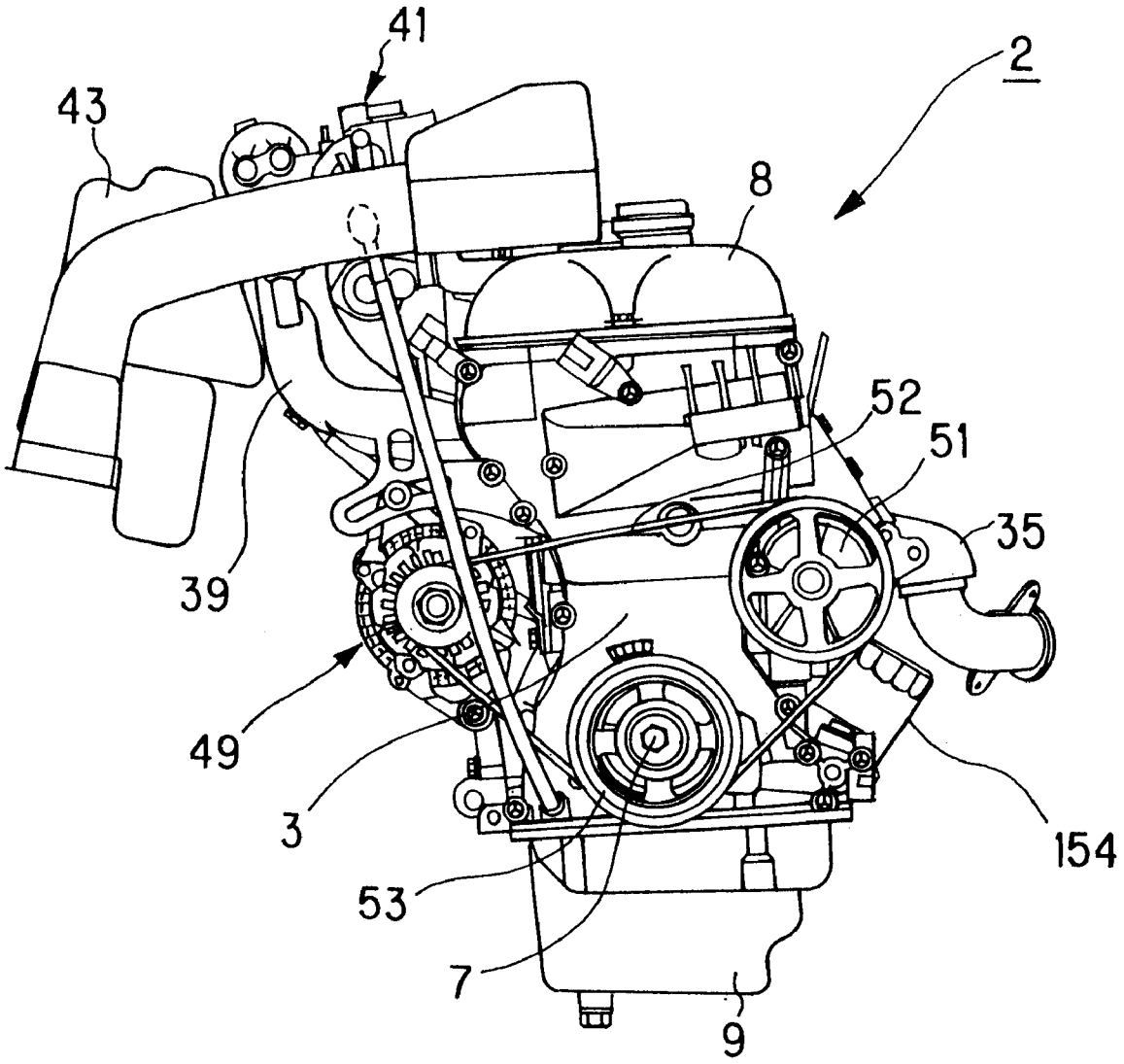
FIG. 5 is a side view showing an engine configuration in accordance with the present embodiment.
Figure 6:
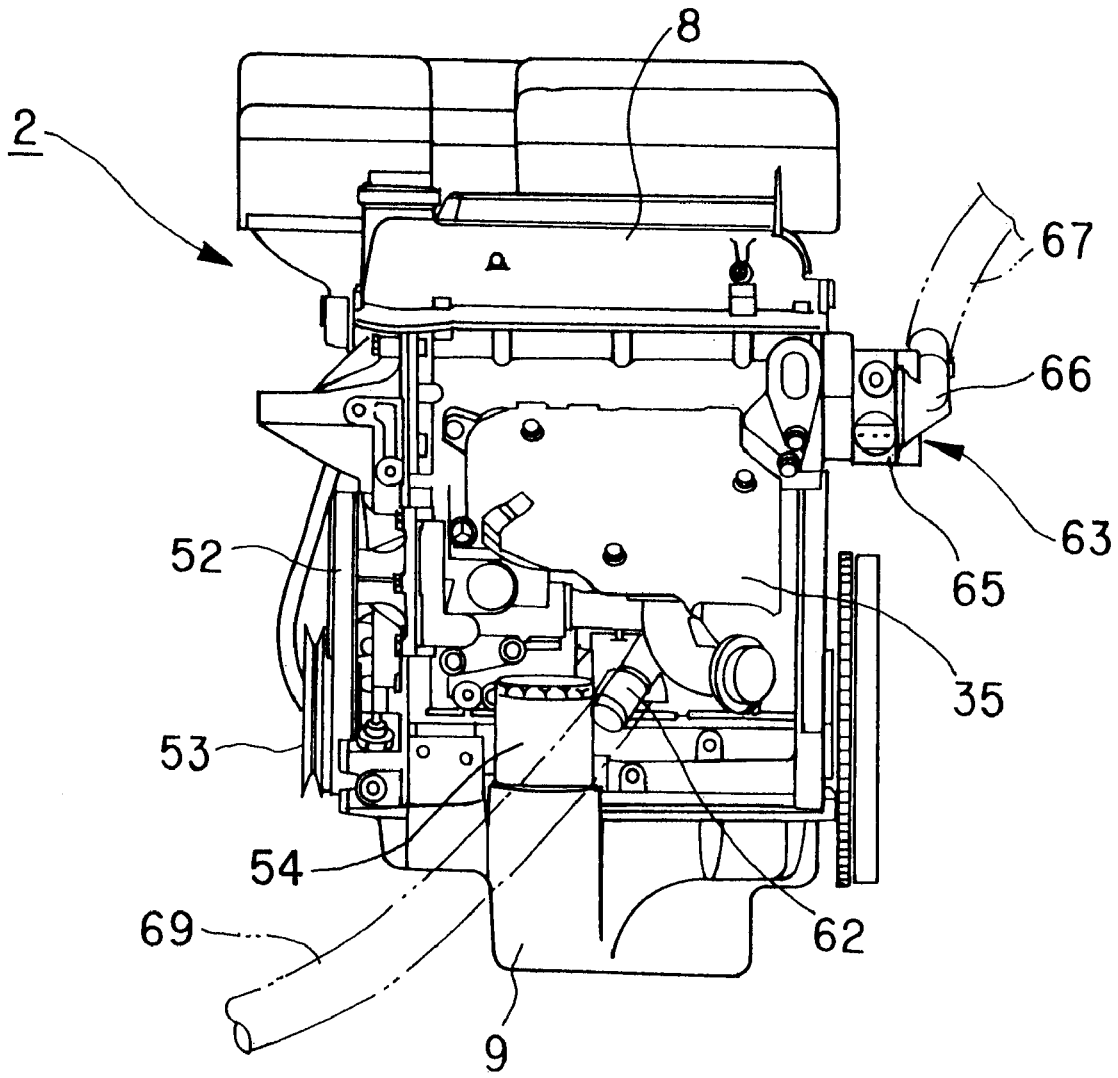
FIG. 6 is a front view showing the engine configuration.
Figure 7:
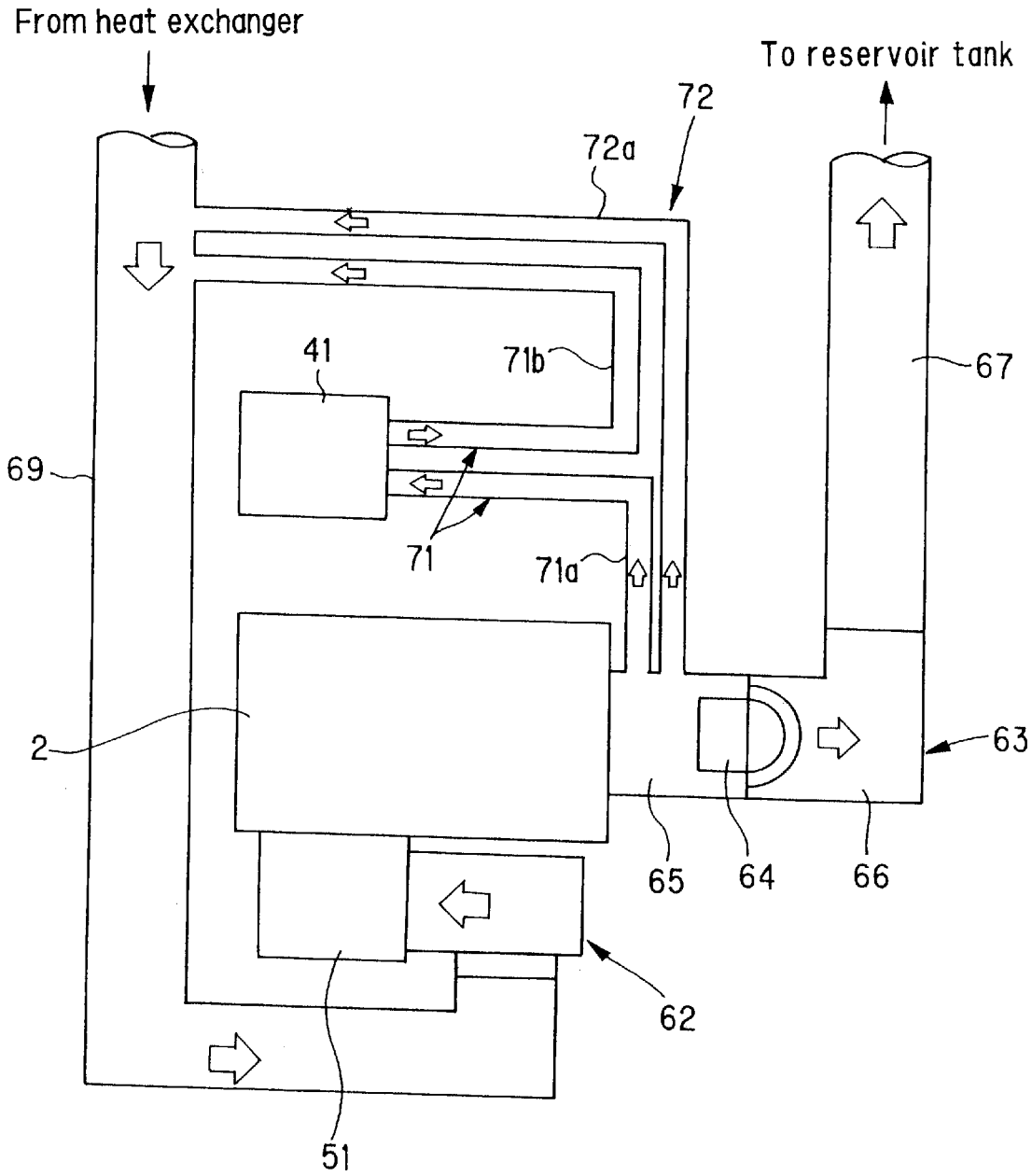
FIG. 7 is an illustrative view schematically showing a cooling arrangement of the engine.

FIG. 1 is a side view showing the overall configuration of a snowmobile in accordance with the embodiment of the present invention; FIG. 2 is a plan view showing the overall configuration of the snowmobile; FIG. 3 is a side view showing the engine layout in the engine room; FIG. 4 is a plan view showing the engine layout in the engine room; FIG. 5 is a side view showing an engine configuration in accordance with the present embodiment; FIG. 6 is a front view showing the engine configuration; and FIG. 7 is an illustrative view schematically showing a cooling arrangement of the engine.

As shown in FIGS. 1 and 2, this embodiment is of a small snow vehicle, a so-called snowmobile 1 with a water-cooled engine 2 of the present invention mounted thereon.

The snowmobile 1 has a pair of steerable ski-runners 13, left and right, under a front frame (engine mount frame) 11 in the front body of a body frame 10 which extends in the front-to-rear direction. These steerable ski-runners 13 are rotatably mounted so that they turn left and right. Arranged under the rear frame, designated at 12, in the rear body is a tractive crawler 16 which circulates a track belt 15. This crawler 16 comprises a drive wheel 17 arranged at the front end of rear frame 12, an idle wheel 18 arranged at the rear end and a multiple number of middle wheels 19, a suspension mechanism 20 and the track belt 15 wound around these wheels and driven circulatively.

The body frame 10 has a monocoque frame configuration. The front frame 11 on which engine 2 is mounted is so shaped that the part in front of a main part 11*a* is raised upward forming a front suspension housing 11*b* for accommodating the upper part of a front suspension 13*a* for supporting steerable ski-type runners 13.

The rear frame 12 is extended to the rear with respect to the front-to-rear direction of the vehicle and also serves as the cover for accommodating the entire crawler 16 under it. A saddle type seat 22 is arranged on the top of rear frame 12 with steps 23 disposed at a lower level than the seat 22 on both sides of seat 22.

A steering post 25 is projectively arranged between the seat 22 and front frame 11 or in the approximate center of the body. A pair of steering bars 26 are attached at the top end of the steering post 25 so that they are slightly inclined rearwards and extended horizontally left and right. These steering bars 26 are used to control steerable ski-runners 13 via steering post 25.

As shown in FIGS. 3 and 4, an instrument panel 27 is arranged around and in front of the steering bars 26 so as to cover the top part of front frame 11. This instrument panel 27 has a speedometer/tachometer 27*a* and other instruments mounted thereon. A wind shield 28 is provided with its upper rim tilted to the rear so that it encloses the instrument panel 27 along its front boundary from the front side to the both sides. In front of the instrument panel 27, an engine hood 29 is formed from the base of the windshield 28, in a substantially streamline shape, or in a substantially inverted, hull-bottom shape gradually lowering to the front.

The engine hood 29 is disposed in front of instrument panel 27 so that it starts at a position stepped down a degree from the front end of the instrument panel 27 toward its front end. A headlight 31 for forward illumination is arranged at the stepped portion between the engine hood 29 and instrument panel 27. In this way, an engine room 30 is formed under the thus arranged instrument panel 27 and engine hood 29.

Next, the configuration of engine 2 in engine room 30 will be described in detail.

As shown in FIGS. 1 and 2, engine 2 is arranged at the approximate center of engine room 30 formed at a position close to the bottom part of steering post 25 in front frame 11 as the front body of snowmobile 1 with its cylinder block 3 inclined to the rear with respect to the snowmobile's direction of travel (with the center of cylinder head 4 positioned more rearwards than the crankshaft, designated at 7).

As shown in FIGS. 3 and 4, this engine 2 is a water-cooled four-cycle engine having a cylinder block 3 with three cylinders arranged in line in the widthwise direction and covered by a cylinder head 4 on the top of the cylinder block. This engine is arranged at the approximate center in the front body of snowmobile 1 in such a state that the crankshaft, designated at 7, of the engine is disposed substantially parallel to the widthwise direction of the body and the cylinder block 3 is tilted to the rear of the vehicle (rear tilted by an angle of θ degrees).

Arranged on the rear side of the engine 2 body and in front of steering post 25 or between engine 2 body and steering post 25 is an intake passage including an intake manifold 39, throttle body 41 and air cleaner box 43. An alternator 49 is arranged under the intake passage and behind cylinder block 3.

Part of the intake passage including the throttle body 41 is disposed at a position higher than cylinder head 4 and is interposed in the space, inside engine room 30, above engine 2 under instrument panel 27 and behind headlight 31. The air cleaner box 43 is provided behind head cover 8 covering the cylinder head 4.

A drive transmission device 32 for driving crawler 16 is disposed on one side of the engine 2 with respect to the widthwise direction of the body.

As shown in FIG. 4, the drive transmission device 32 has a drive clutch 33 which is engaged on one end of crankshaft 7 projected from the engine wall on one side with respect to the widthwise direction of the body to provide driving force and a driven clutch 34 which is coupled to drive wheels 17 of crawler 16 for receiving driving force, whereby the output from engine 2 is taken out from crankshaft 7 and the driving force is transmitted from the drive clutch 33 to the driven clutch 34. The drive force is transmitted in a stepless manner from the drive clutch 33 to the driven clutch 34 by means of a drive belt 33*a*.

The cylinder head 4 has an exhaust manifold 35 projectively extended forwards from the front side thereof and intake manifold 39 projectively extended rearwards from the rear side thereof.

An oil pan 9 is disposed under the cylinder block 3 and close to the bottom of engine room 30.

As shown in FIGS. 3 and 4, in the rear part of engine room 30, a reservoir tank 60 for cooling water is arranged at the side of intake manifold 39 behind the cylinder block 3 and over oil pan 9, alternator 49 and an after mentioned heat exchanging means or heat exchanger, at a position adjacent to drive belt 52.

Further, in engine room 30, a heat exchanger 70*a* is provided under the front part of the rear frame 12 and over the front part, with respect to the vehicle's direction of travel, of crawler 16, so as to oppose, in an approximately parallel fashion, a track belt 15. Another heat exchanger 70*b* is arranged in front of the front side, with respect to the vehicle's direction of travel, of crawler 16, in such a manner that it opposes track belt 15 with its upper side slightly tilted rearwards. These heat exchangers 70*a* and 70*b* have rectangular shapes when placed flat.

Further, in the front space of engine 2, exhaust manifold 35 arranged in front of cylinder head 4 is connected to an exhaust pipe 36, which is in turn connected to a muffler 50 located at a position more frontwards, or in the vicinity of a front suspension housing 11*b* formed in the bottom of the main part 11*a* of frame front 11.

Arranged in front of cylinder block 3 under the exhaust manifold 35 is a water pump 51 at a position approximately opposite the alternator 49 with the cylinder block 3 in between. This water pump 51 is driven together with the alternator 49 by the rotational force transmitted by a drive belt 52 which is driven by a drive pulley 53 engaged at one end of crankshaft 7, whereby it ejects and supplies cooling water by way of a cooling water hose (not shown) to a water jacket (not shown) formed inside the engine to thereby cool engine 2.

An oil filter 54 is arranged in front of cylinder block 3 under this water pump 51.

As shown in FIG. 4, a cooling water inlet port 62 for leading cooling water into the cooling water jacket (not shown) inside the engine is projectively formed in front, with respect to the vehicle's direction of travel, of the cylinder block 3 under exhaust manifold 35, at a position close to drive belt 52.

A cooling water outlet port 63 through which cooling water is taken out from the cooling water jacket is projectively formed at an upper position on one side of the engine opposite to the drive belt side.

As shown in FIGS. 4, 6 and 7, a thermo housing 65 incorporating a thermostat 64 for regulating the flow of cooling water in accordance with the cooling water temperature and a thermo cap 66 for covering the thermostat 64 are provided in cooling water outlet port 63.

This thermo cap 66 is connected to reservoir tank 60 through a cooling water hose 67 so that the cooling water from the inside of the engine returns to the reservoir tank 60.

The reservoir tank 60 is connected to the aforementioned heat exchanger 70*a* via a cooling water hose 68. The heat exchangers 70*a* and 70*b* are connected by a connecting hose 70*c*. Heat exchanger 70*b* is connected to cooling water inlet port 62 formed on the engine 2 side, by way of a cooling water hose 69. Arranged at an approximately halfway position along cooling water hose 69 is a block heater 75 which covers part of the outer periphery of the hose so as to partially heat the cooling water.

As shown in FIG. 7, the thermo housing 65 is formed with a first cooling water bypass passage 71 which branches off at a point upstream, with respect to the flow of cooling water, of the thermostat and is connected by way of throttle body 41 to cooling water hose 69 at a point upstream of water pump 51 and a second cooling water bypass passage 72 which branches off at a point upstream of the thermostat 64 and is connected directly to cooling water hose 69 at a point upstream of water pump 51 without passing through the throttle body 41.

The first cooling water bypass passage 71 is composed of a first cooling water bypass hose 71*a* which is connected at its one end to the point upstream, with respect to the flow of cooling water, of thermostat 64 of the thermo housing 65 and connected at the other end to the inlet to the cooling water passage (not shown) formed inside throttle body 41 and another first cooling water bypass hose 71*b* which is connected at its one end to the outlet from the cooling water passage formed inside throttle body 41 and connected at the other end to cooling water hose 69 at a point upstream of water pump 51.

The second cooling water bypass passage 72 is composed of a second cooling water bypass hose 72*a* which is connected at its one end to the point upstream, with respect to the flow of cooling water, of the thermostat of the thermo housing 65 and connected at the other end to cooling water hose 69 at a point upstream of water pump 51.

The first cooling water bypass hoses 71*a* and 71*b* and the second cooling water bypass hose 72*a* are adapted to constantly keep communication between the thermo housing 65 side and the cooling water hose 69 side.

Next, the operation of the cooling arrangement for a snowmobile engine in accordance with the present embodiment will be described with reference to the drawings.

To begin with, cooling water is introduced by water pump 51 from cooling water inlet port 62 into the cooling water jacket inside engine 2, as shown in FIG. 7.

The input cooling water, as it goes through the cooling water jacket inside cylinder block 3 and cylinder head 4 and cools the parts of the engine, is increased in temperature and discharged out from the engine through cooling water outlet port 63 formed at the top of cylinder head 4.

When discharged, part of the cooling water is sent out from thermo housing 65 to the first cooling water bypass passage 71 and the second cooling water bypass passage 72, the rest being set out passing through thermostat 64 and thermo cap 66 to cooling water hose 67.

The cooling water sent into the first cooling water bypass passage 71 is led into the cooling water jacket (not shown) formed inside throttle body 41 by way of the first cooling water bypass hose 71*a*. The throttle body 41 is warmed to a predetermined temperature by cooling water which has been warmed. Then the water is returned to cooling water hose 69 from throttle body 41 through the first cooling water bypass hose 71*b*.

The cooling water sent into the send cooling water bypass passage 72 is directly returned to cooling water hose 69 through the second cooling water bypass hose 72*a*, instead of its being cooled.

On the other hand, the cooling water which is led to thermostat 64 is controlled as to its amount of flow and sent to thermo cap 66. The cooling water is further sent to reservoir tank 60 through cooling water hose 68. Then the water is sent from the reservoir tank 60 to heat exchanger 70*a*. The cooling water is cooled as it goes through the cooling water passage inside the heat exchanger 70*a*, and then sent to the heat exchanger 70*b* disposed on the front side, where it is further cooled. The water leaving heat exchanger 70*b* is re-supplied to water pump 51 and then sent into the cooling water jacket inside engine 2 for another cycle of the above-described cooling process to cool engine 2. Within this circuit, the cooling water sent to water pump 51 can be warmed appropriately by block heater 75 and adjusted as to its temperature while it passes through cooling water hose 69.

In this way, the cooling arrangement of this embodiment is configured so that the engine is cooled by a multiple number of cooling water routes, namely the first cooling water bypass passage and the second cooling water bypass passage in addition to the ordinary cooling water passage.

As has been described heretofore, according to the cooling arrangement for a snowmobile engine of this embodiment, part of the cooling water which has been warmed through the engine is circulated directly by way of the first cooling water bypass passage 71 and the second cooling water bypass passage 72, instead of passing through heat exchangers 70*a* and 70*b*. Accordingly, since the throttle body 41 and the engine 2 body will not be significantly varied in temperature, it is possible to stabilize the engine idling speed at the start of operation. Further, the cooling water can be regulated so as to keep the cooling water at a stabilized temperature without its being overcooled. It is also possible to avoid engine 2 being cooled more than needed during the warm-up of engine 2.

According to the present embodiment, since cooling water inlet port 62 is projectively formed at a position close to drive belt 52 on the front side, with respect to the vehicle's direction of travel, of cylinder block 3, under exhaust manifold 35 while cooling water outlet port 63 is projectively formed at a position close to the side opposite to the drive belt on the engine's side face, the cooling water flows through the engine interior, approximately diagonally from the bottom to the top, hence the water is able to efficiently flow and discharge without stagnation within cylinder head 4 and within cylinder block 3. Thus, this configuration provides an improved cooling efficiency compared to the conventional configuration.

Further, according to the present embodiment, reservoir tank 60 is arranged at the side of intake manifold 39 over oil pan 9, alternator 49 and heat exchanger 70*b* and close to drive belt 52 in the space at the top inside engine room 30, it is possible to improve the work performance in supplying cooling water whilst realizing a space-saving engine layout.

According to the present embodiment, since the thermo housing 65 side and cooling water hose 69 side are kept so as to be in constant communication to each other through the first cooling water bypass passage 71 and the second cooling water bypass passage 72, it is possible to always keep engine 2 at a fixed temperature. Therefore, it is possible to prevent engine seizure and other troubles by readily reacting to the cooling water temperature which varies dependent on the operational condition of the engine.

According to the present embodiment, since water pump 51 is arranged under exhaust manifold 35 and on the side opposite to alternator 49 with cylinder block 3 in between, it is possible to realize a space-saving layout utilizing the dead space under exhaust manifold 35. Further, since the water pump 51 is driven by the common drive source for alternator 49, that is, it is driven by the rotational force which is transmitted through drive belt 52 from the drive pulley 53 engaged to one end of crankshaft 7, no special parts are needed for driving water pump 51, hence it is possible to reduce the number of parts.

Though the description of the present embodiment has been made as to a water-cooled engine, the present invention can also be applied to other liquid-cooled engines in which oil or any other coolant is used for cooling the engine and can produce the same effects as the present embodiment does.

It should be noted that the cooling arrangement for a snowmobile engine of the present invention is not limited to the above illustrated configuration, but various modifications can be of course added without departing from the scope of the features of the present invention.

Next, the first variational example of the embodiment of the present invention will be described with reference to the drawings.

FIGS. 8 to 12 show the first variation of the above embodiment. In the drawings, components allotted with the same reference numerals as those in the above embodiment should be understood to represent the same components as shown therein.

Figure 8:
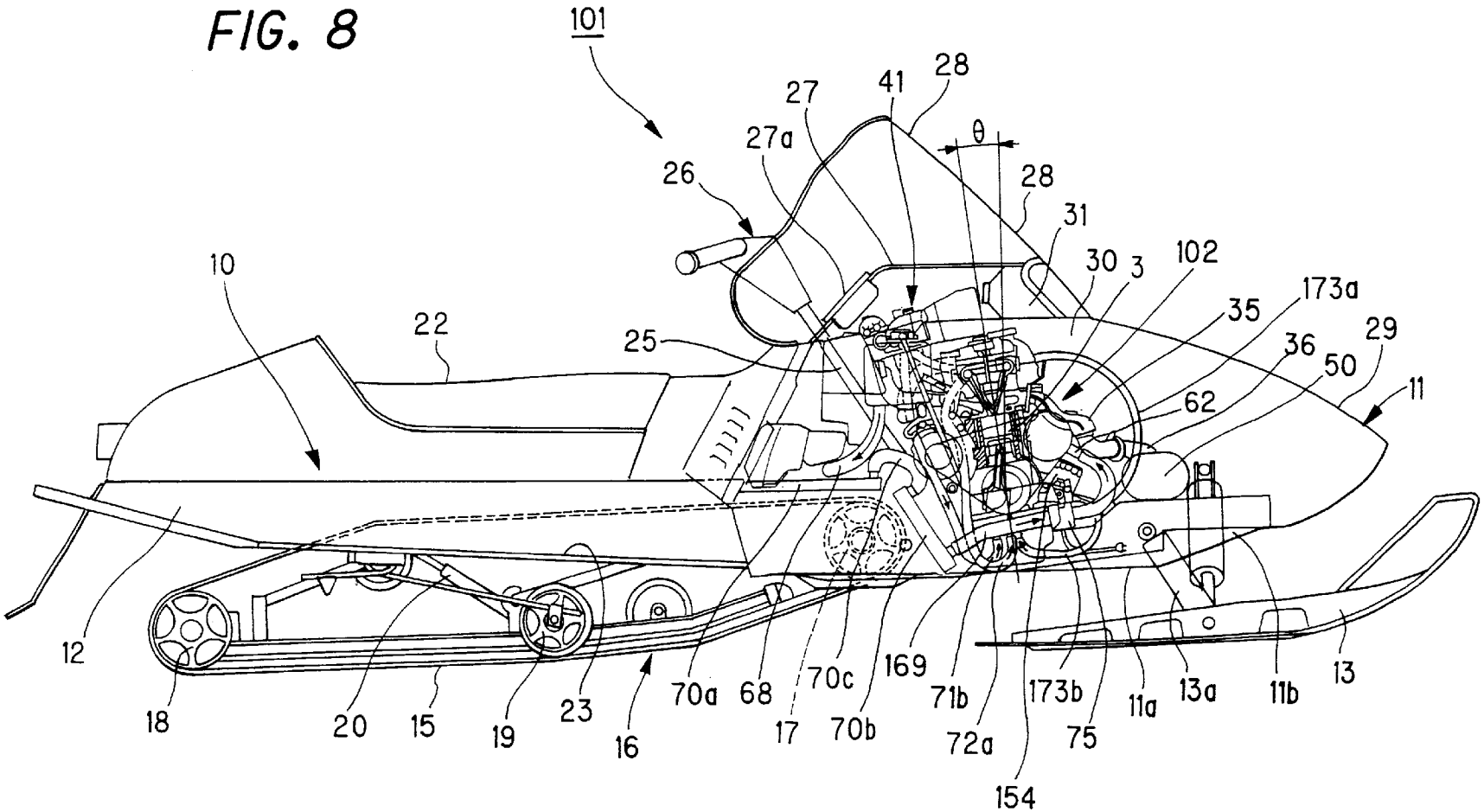
FIG. 8 is a side view showing the overall configuration of a snowmobile in accordance with a first variation of the present embodiment.
Figure 9:
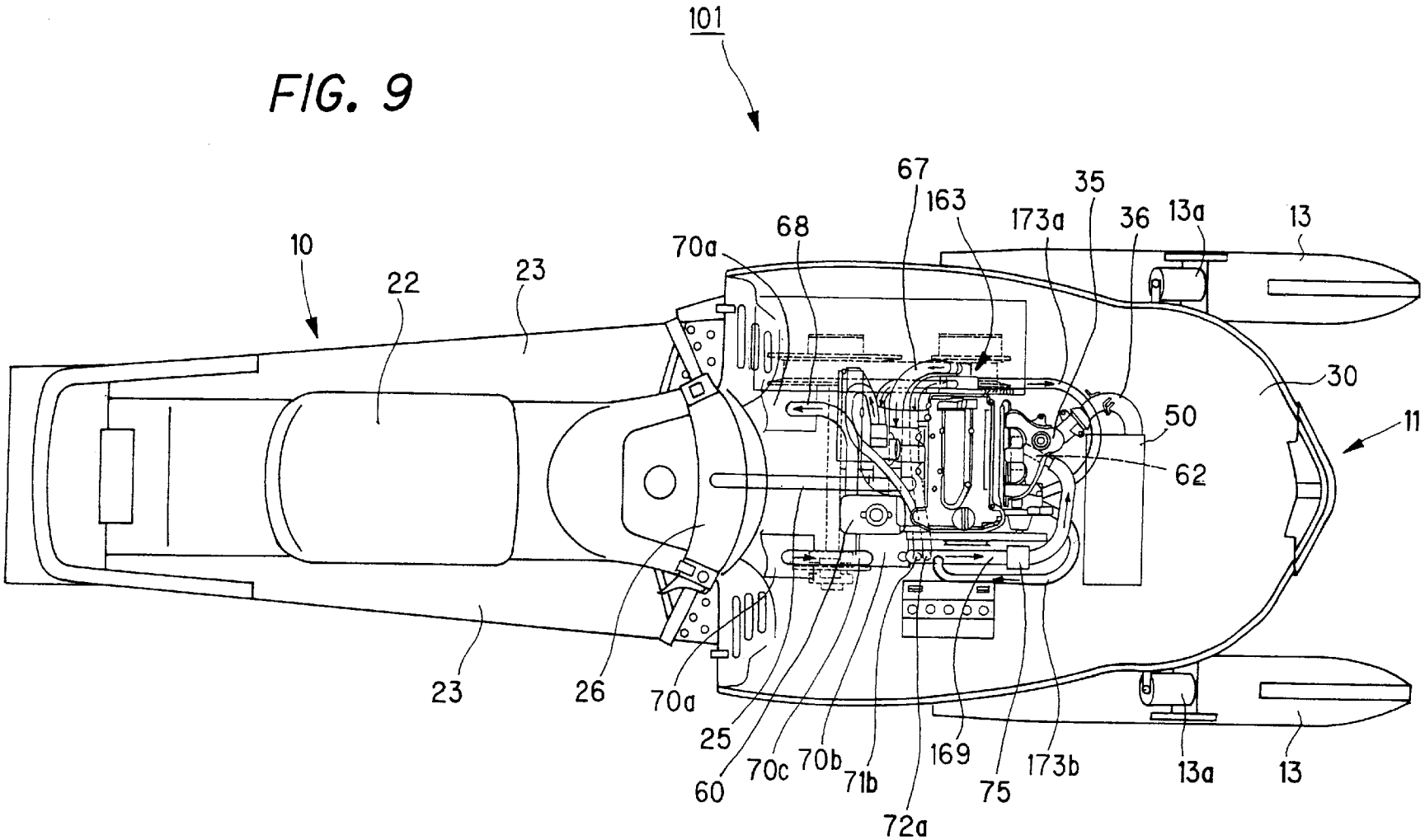
FIG. 9 is a plan view showing the overall configuration of the snowmobile.
Figure 10:
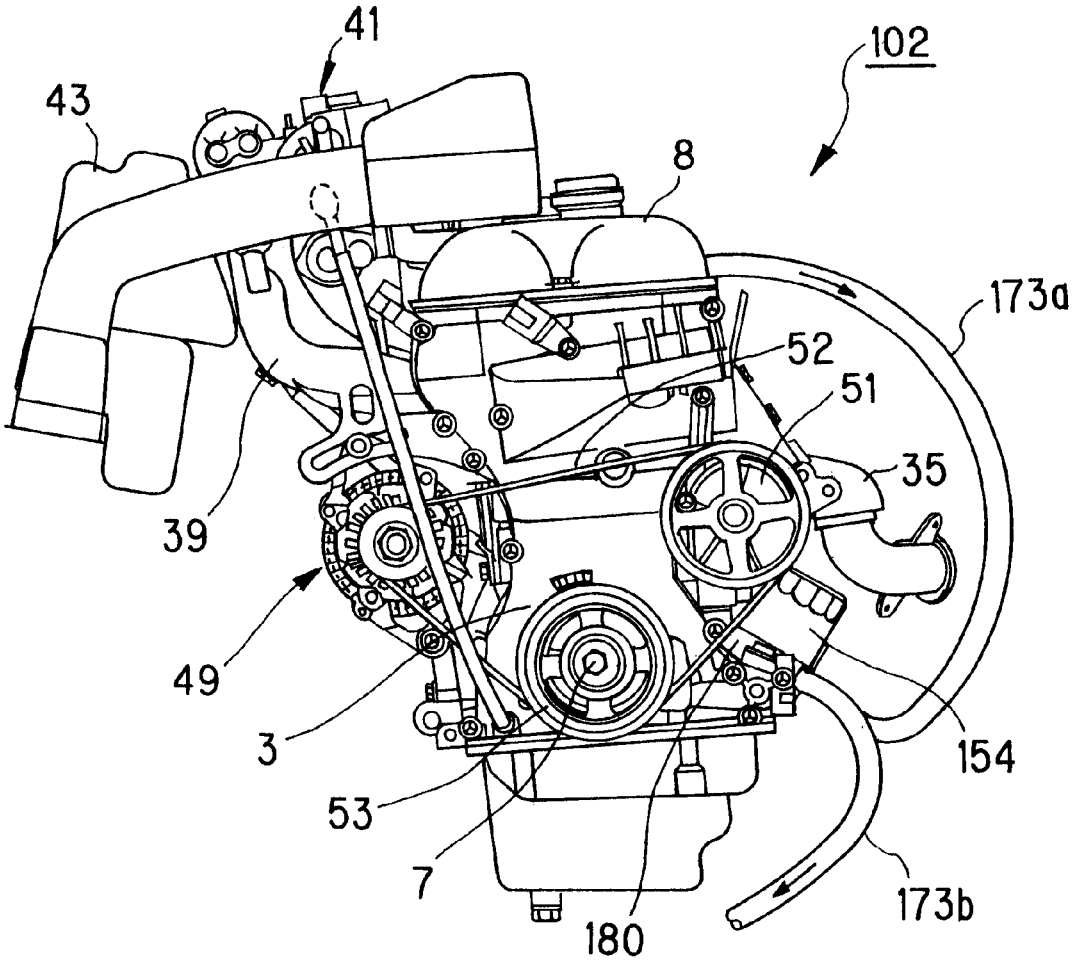
FIG. 10 is a side view showing an engine configuration of the first variation
Figure 11:
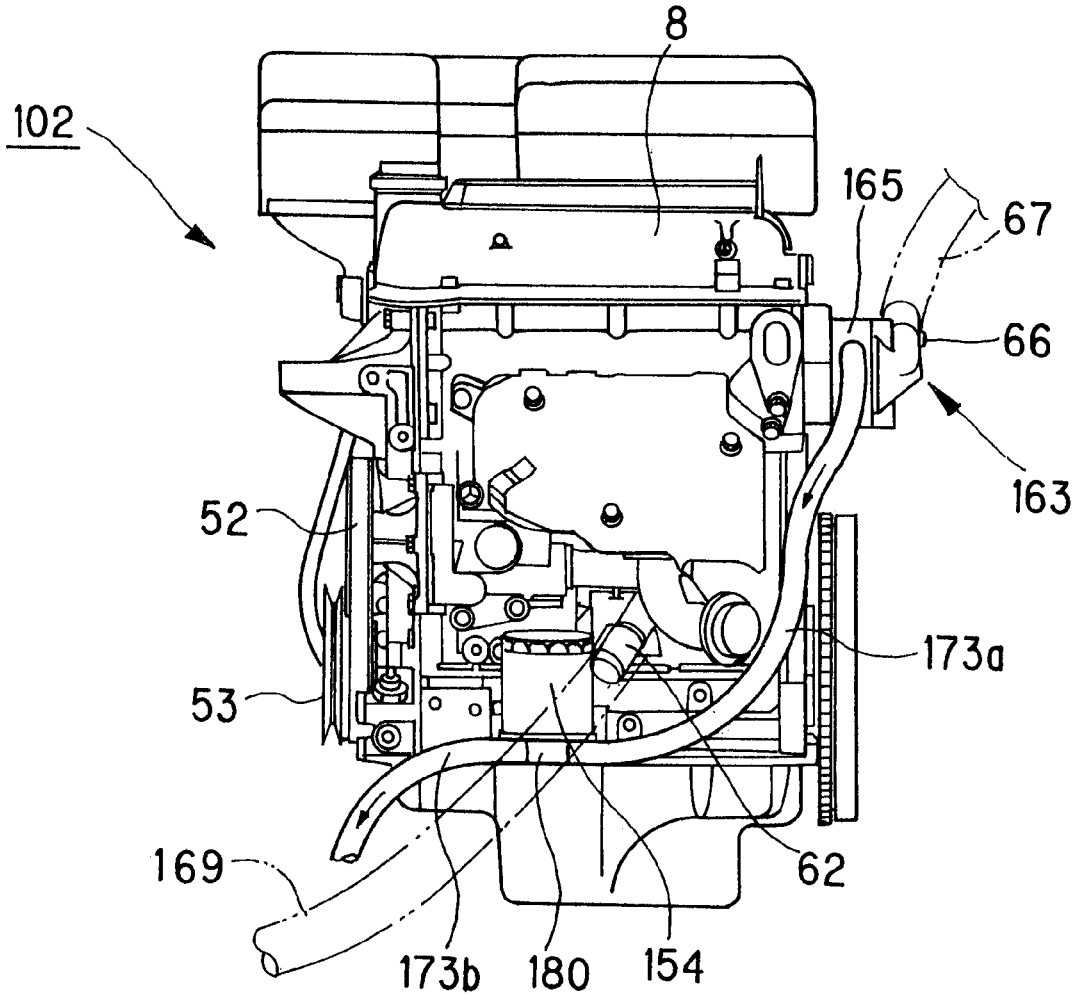
FIG. 11 is a front view showing the engine configuration.

As shown in FIGS. 8 and 9, in the configuration of an engine 102 of a snowmobile 101 of the first variational example, an oil filter 154 is arranged on the front side, with respect to the vehicle's direction of travel, of a cylinder block 3 and an oil cooler 180 is interposed between the oil filter 154 and cylinder block 3.

A cooling water inlet port 62 for leading cooling water into a cooling water jacket (not shown) inside the engine is projectively formed in front, with respect to the vehicle's direction of travel, of the cylinder block 3 of engine 102, under an exhaust manifold 35, at a position close to a drive belt 52.

A cooling water outlet port 163 through which cooling water is taken out from the cooling water jacket is projectively formed at an upper position on the side face, the side opposite to the drive belt side, of a cylinder head 4 provided on the top of cylinder block 3.

Figure 12:
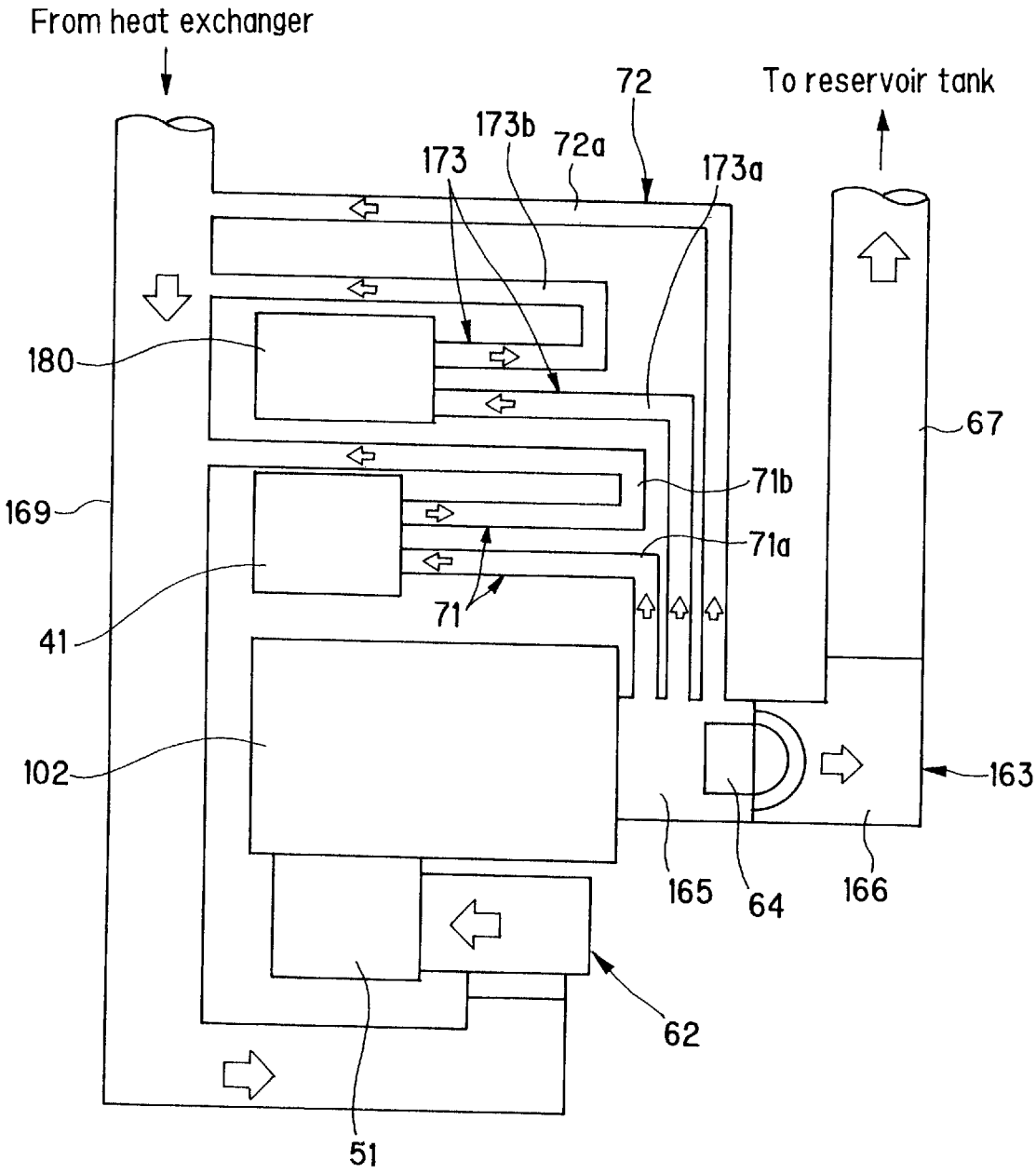
FIG. 12 is an illustrative view schematically showing a cooling arrangement of the engine.

As shown in FIG. 12, a thermo housing 165 incorporating a thermostat 64 for regulating the flow of cooling water in accordance with the cooling water temperature and a thermo cap 166 for covering the thermostat 64 are provided in cooling water outlet port 163.

Further, in engine room 30, a heat exchanger 70*a* is provided under the front part of the rear frame 12 and over the front part, with respect to the vehicle's direction of travel, of a crawler 16, so as to oppose, in an approximately parallel fashion, a track belt 15. Another heat exchanger 70*b* is arranged in front of the front side, with respect to the vehicle's direction of travel, of crawler 16, in such a manner that it opposes track belt 15 with its upper side slightly tilted rearwards. These heat exchangers 70*a* and 70*b* have rectangular shapes when placed flat.

This thermo cap 166 is connected to a reservoir tank 60 through a cooling water hose 67 so that the cooling water from the inside of the engine returns to the reservoir tank 60.

The reservoir tank 60 is connected to the aforementioned heat exchanger 70*a* via a cooling water hose 68. The heat exchangers 70*a* and 70*b* are connected by a connecting hose 70*c*. Heat exchanger 70*b* is connected to cooling water inlet port 62 formed on the engine 2 side, by way of a cooling water hose 169. Arranged at an approximately halfway position along cooling water hose 169 is a block heater 75 which covers part of the outer periphery of the hose so as to partially heat the cooling water.

As shown in FIG. 12, the thermo housing 165 is formed with a first cooling water bypass passage 71 which branches off at a point upstream, with respect to the flow of cooling water, of thermostat 64 and is connected by way of throttle body 41 to cooling water hose 169 at a point upstream of water pump 51, a second cooling water bypass passage 72 which branches off at a point upstream of thermostat 64 and is connected directly to cooling water hose 169 at a point upstream of water pump 51 without passing through the throttle body 41 and a third cooling water bypass passage 173 which branches off at a point upstream, with respect to the flow of cooling water, of thermostat 64 and is connected by way of oil cooler 180 to cooling water hose 169 at a point upstream of water pump 51.

The first cooling water bypass passage 71 is composed of a first cooling water bypass hose 71*a* which is connected at its one end to the point upstream, with respect to the flow of cooling water, of thermostat 64 of the thermo housing 165 and connected at the other end to the inlet to the cooling water passage (not shown) formed inside throttle body 41 and another first cooling water bypass hose 71*b* which is connected at its one end to the outlet from the cooling water passage formed inside throttle body 41 and connected at the other end to cooling water hose 169 at a point upstream of water pump 51.

The second cooling water bypass passage 72 is composed of a second cooling water bypass hose 72*a* which is connected at its one end to the point upstream, with respect to the flow of cooling water, of the thermostat of the thermo housing 165 and connected at the other end to cooling water hose 169 at a point upstream of water pump 51.

The third cooling water bypass passage 173 is composed of a third cooling water bypass hose 173*a* which is connected at its one end to the point upstream, with respect to the flow of cooling water, of thermostat 64 of the thermo housing 165 and connected at the other end to the inlet to the cooling water passage (not shown) formed inside oil cooler 180 and another third cooling water bypass hose 173*b* which is connected at its one end to the outlet from the cooling water passage formed inside oil cooler 180 and connected at the other end to cooling water hose 169 at a point upstream of water pump 51.

The first cooling water bypass passage 71, the second cooling water bypass passage 72 and the third cooling water bypass passage 173 are adapted to constantly keep communication between the thermo housing 165 side and the cooling water hose 169 side.

This thermo cap 166 is connected to a reservoir tank 60 through a cooling water hose 67 so that the cooling water from the inside of the engine returns to the reservoir tank 60.

According to this configuration, the cooling water for cooling engine 102 can be used not only for engine 102 but also for oil cooler 180 so as to efficiently cool the engine oil. Thus, this configuration makes is possible to operate the engine in a good condition.

Next, the second variational example of the embodiment of the present invention will be described in detail with reference to the drawings.

Figure 13:
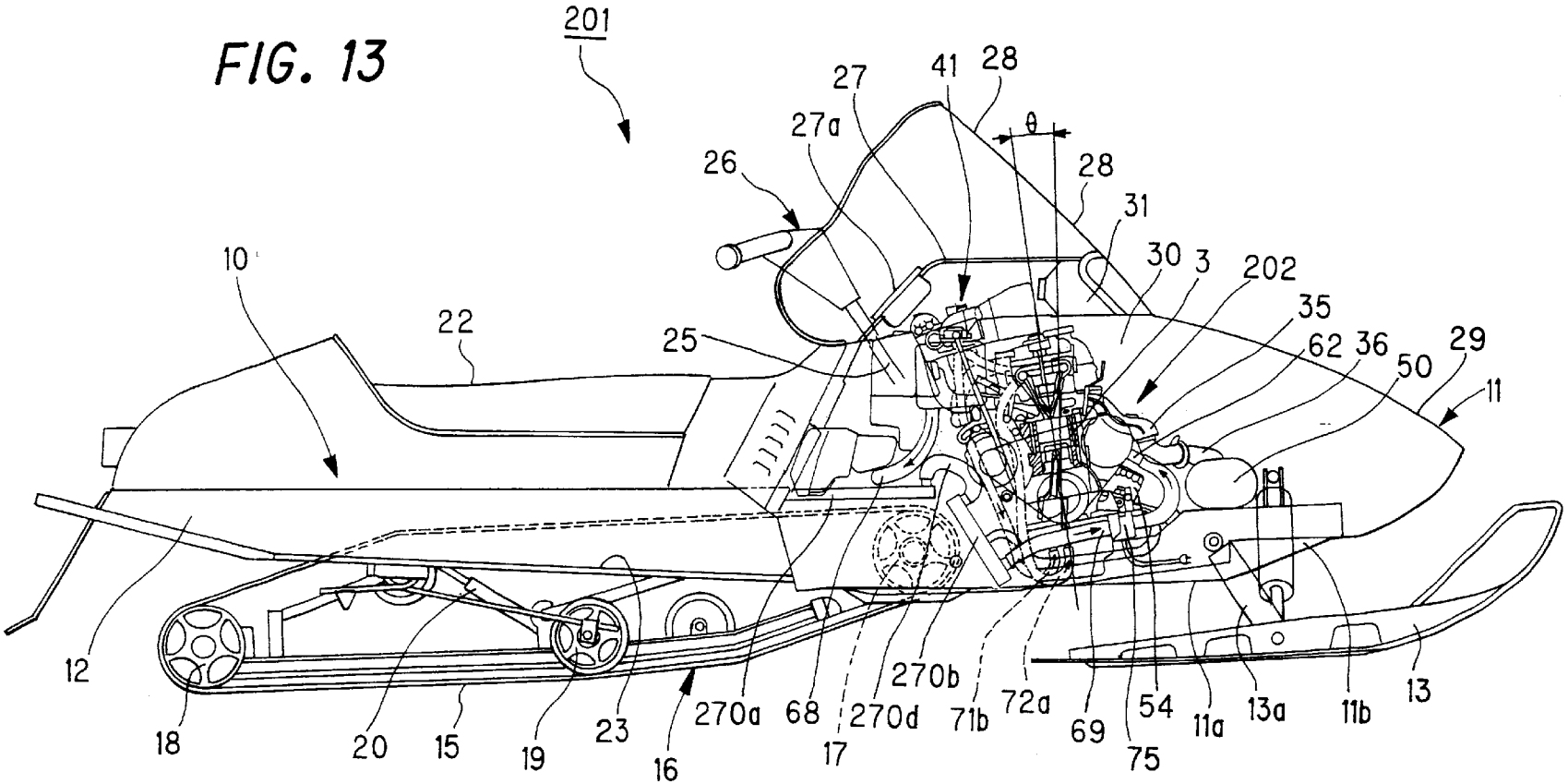
FIG. 13 is a side view showing the overall configuration of a snowmobile in accordance with a second variation of the present embodiment.
Figure 14:
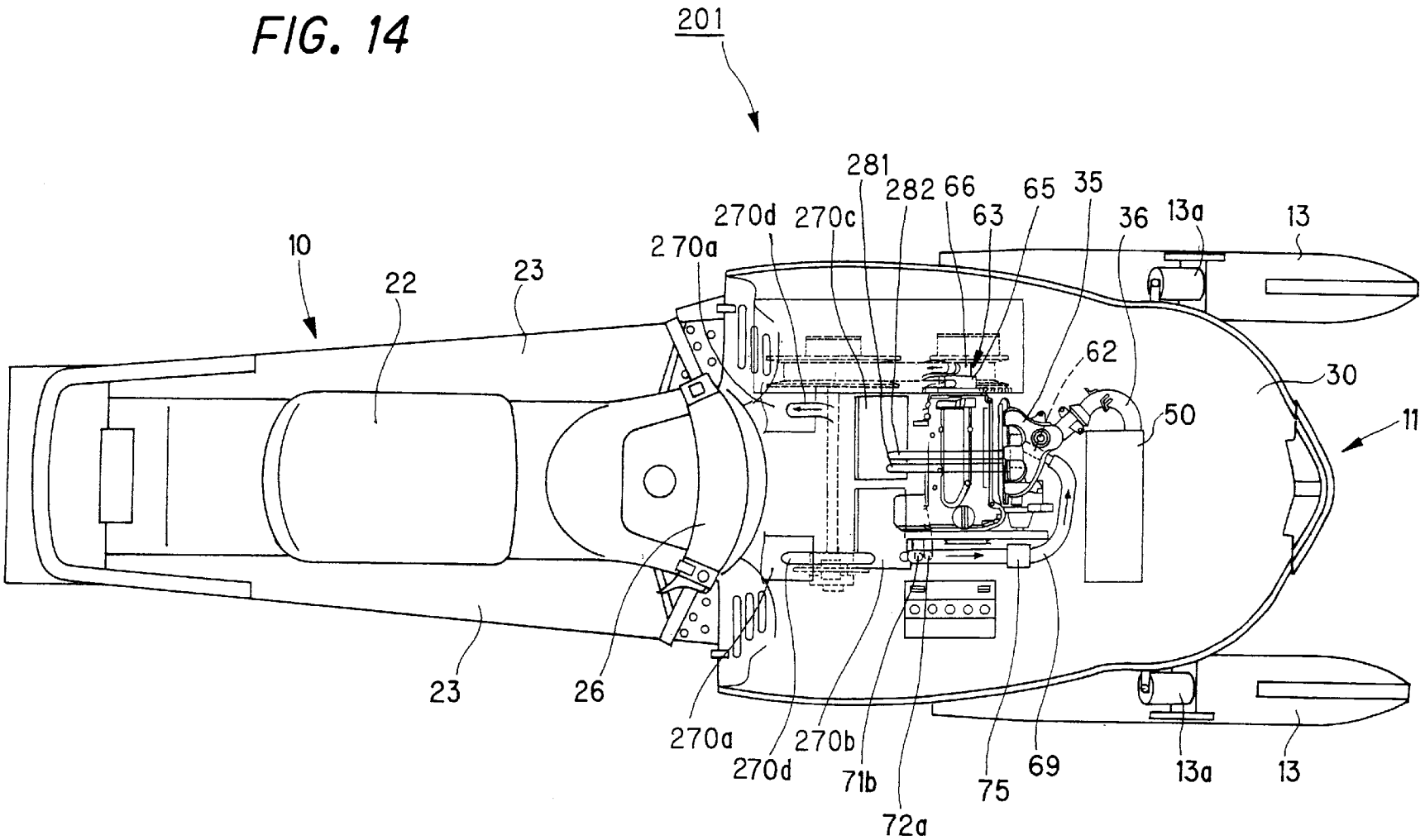
FIG. 14 is a plan view showing the overall configuration of the snowmobile.
Figure 15:
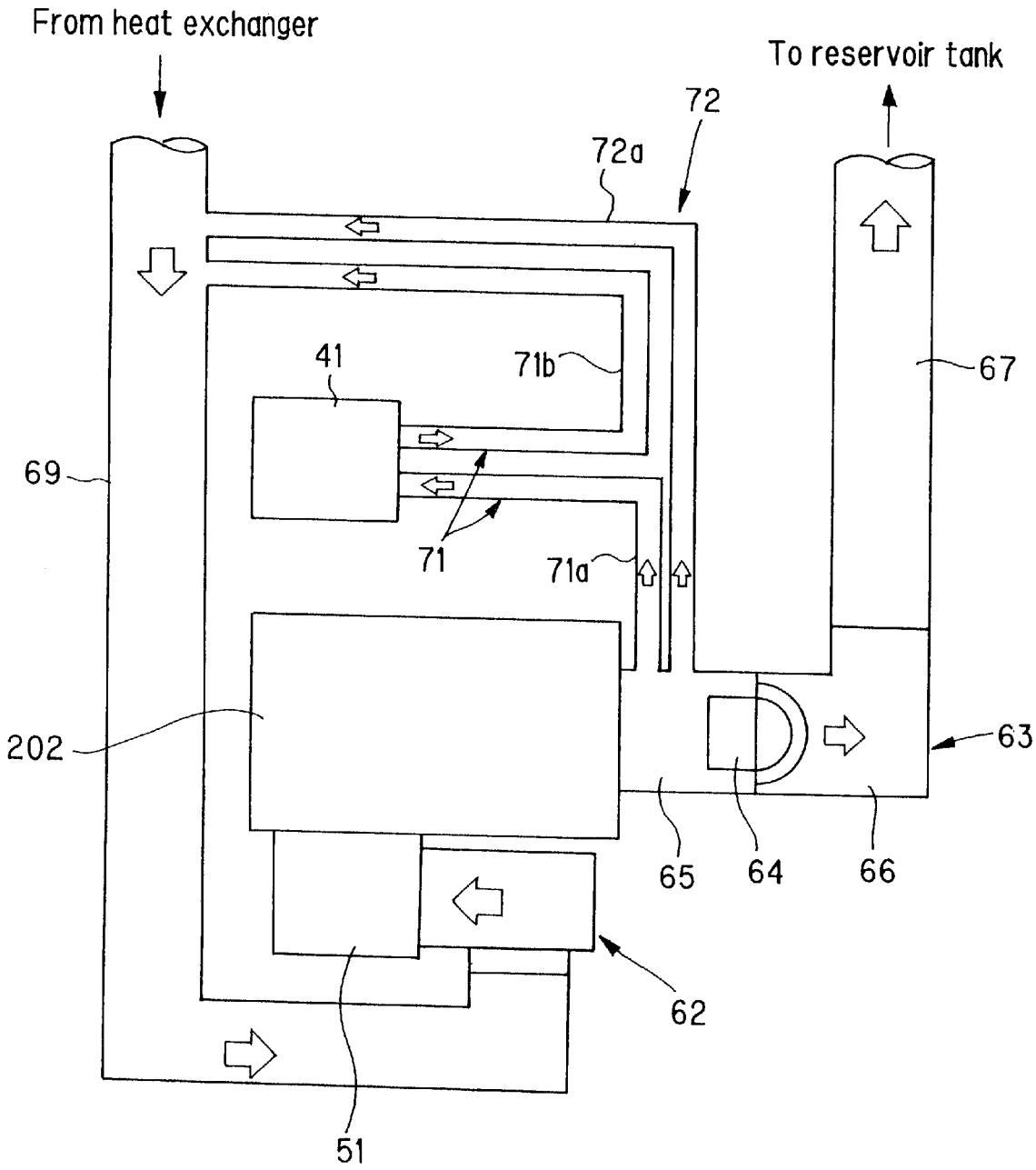
FIG. 15 is an illustrative view schematically showing a cooling arrangement of the engine.

FIGS. 13 to 15 show the second variation of the above embodiment. In the drawings, components allotted with the same reference numerals as those in the above embodiments should be understood to represent the same components as shown therein.

As shown in FIGS. 13 and 14, in a snowmobile 201 of this second variational example, a heat exchanger for oil cooling is arranged in front, with respect to the vehicle's direction of travel, of crawler 16 for causing snowmobile 201 to move.

A cooling water inlet port 62 for leading cooling water into a cooling water jacket (not shown) inside the engine is projectively formed in front, with respect to the vehicle's direction of travel, of the cylinder block 3 of engine 202, under an exhaust manifold 35, at a position close to a drive belt 52.

A cooling water outlet port 63 through which cooling water is taken out from the cooling water jacket is projectively formed at an upper position on the side face, the side opposite to the drive belt side, of a cylinder head 4 provided on the top of cylinder block 3.

As shown in FIG. 15, a thermo housing 65 incorporating a thermostat 64 for regulating the flow of cooling water in accordance with the cooling water temperature and a thermo cap 66 for covering the thermostat are provided in cooling water outlet port 63.

Concerning the aforementioned heat exchanger in engine room 30 shown in FIGS. 13 and 14, a heat exchanger 270*a* for cooling water is provided under the front part of the rear frame 12 and over the front part, with respect to the vehicle's direction of travel, of a crawler 16, so as to oppose, in an approximately parallel fashion, a track belt 15. Heat exchanger 270*b* for cooling water and heat exchanger 270*c* for oil cooling are arranged side by side across the body width, in front of the front side, with respect to the vehicle's direction of travel, of crawler 16, in such a manner that they oppose track belt 15 with their upper sides slightly tilted rearwards. The heat exchanger 270*c* has a rectangular shape when placed flat.

The thermo cap 66 is connected to a reservoir tank 60 through a cooling water hose 67 so that the cooling water from the inside of the engine returns to the reservoir tank 60.

The reservoir tank 60 is connected to the aforementioned heat exchanger 270*a* via a cooling water hose 68. The heat exchangers 270*a* and 270*b* are connected by a connecting hose 270*d*. Heat exchanger 270*b* is connected to cooling water inlet port 62 formed on the engine 2 side, by way of a cooling water hose 69. Arranged at an approximately halfway position along cooling water hose 69 is a block heater 75 which covers part of the outer periphery of the hose so as to partially heat the cooling water.

As shown in FIG. 15, the thermo housing 65 is formed with a first cooling water bypass passage 71 which branches off at a point upstream, with respect to the flow of cooling water, of thermostat 64 and is connected by way of throttle body 41 to cooling water hose 69 at a point upstream of water pump 51 and a second cooling water bypass passage 72 which branches off at a point upstream of thermostat 64 and is connected directly to cooling water hose 69 at a point upstream of water pump 51 without passing through the throttle body 41.

The first cooling water bypass passage 71 is composed of a first cooling water bypass hose 71*a* which is connected at its one end to the point upstream, with respect to the flow of cooling water, of thermostat 64 of the thermo housing 65 and connected at the other end to the inlet to the cooling water passage (not shown) formed inside throttle body 41 and another first cooling water bypass hose 71*b* which is connected at its one end to the outlet from the cooling water passage formed inside throttle body 41 and connected at the other end to cooling water hose 69 at a point upstream of water pump 51.

The second cooling water bypass passage 72 is composed of a second cooling water bypass hose 72*a* which is connected at its one end to the point upstream, with respect to the flow of cooling water, of the thermostat of the thermo housing 65 and connected at the other end to cooling water hose 69 at a point upstream of water pump 51.

The first cooling water bypass passage 71 and the second cooling water bypass passage 72 are adapted to constantly keep communication between the thermo housing 65 side and the cooling water hose 69 side.

This thermo cap 66 is connected to a reservoir tank 60 through a cooling water hose 67 so that the cooling water from the inside of the engine returns to the reservoir tank 60.

The heat exchanger 270*c* for oil cooling has an oil inlet port to which an oil inlet hose 281 from an oil pump (not shown) is connected and an oil outlet port from which an oil outlet hose 282 is connected to an oil filter 54, so that oil is cooled whilst passing through the oil passage formed inside the oil cooler.

According to this configuration, since heat exchanger 270*c* for oil cooling is arranged on the front side, with respect to the vehicle's direction of travel, of crawler 16 for causing snowmobile 201 to move, it is possible to perform efficient cooling by the scattered snow. Further, since two divided heat exchangers are provided, where one is used as usual, heat exchanger 270*b* for cooling water and the other as heat exchanger 270*c* for cooling oil, it is possible to realize different cooling functions using a limited space.

Next, the third variational example of the present invention will be described in detail with reference to the drawings.

Figure 16:
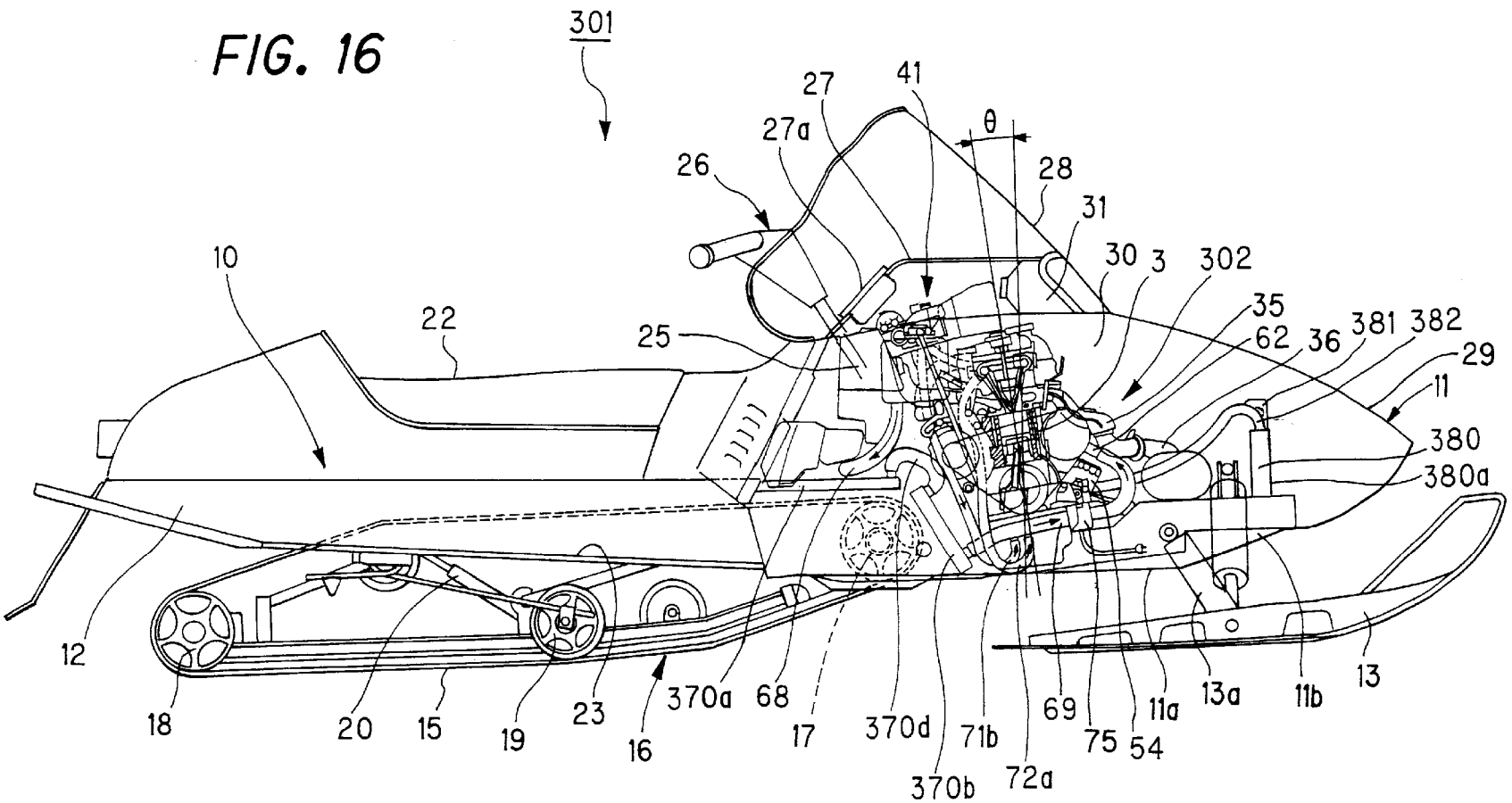
FIG. 16 is a side view showing the overall configuration of a snowmobile in accordance with a third variation of the present embodiment.
Figure 17:
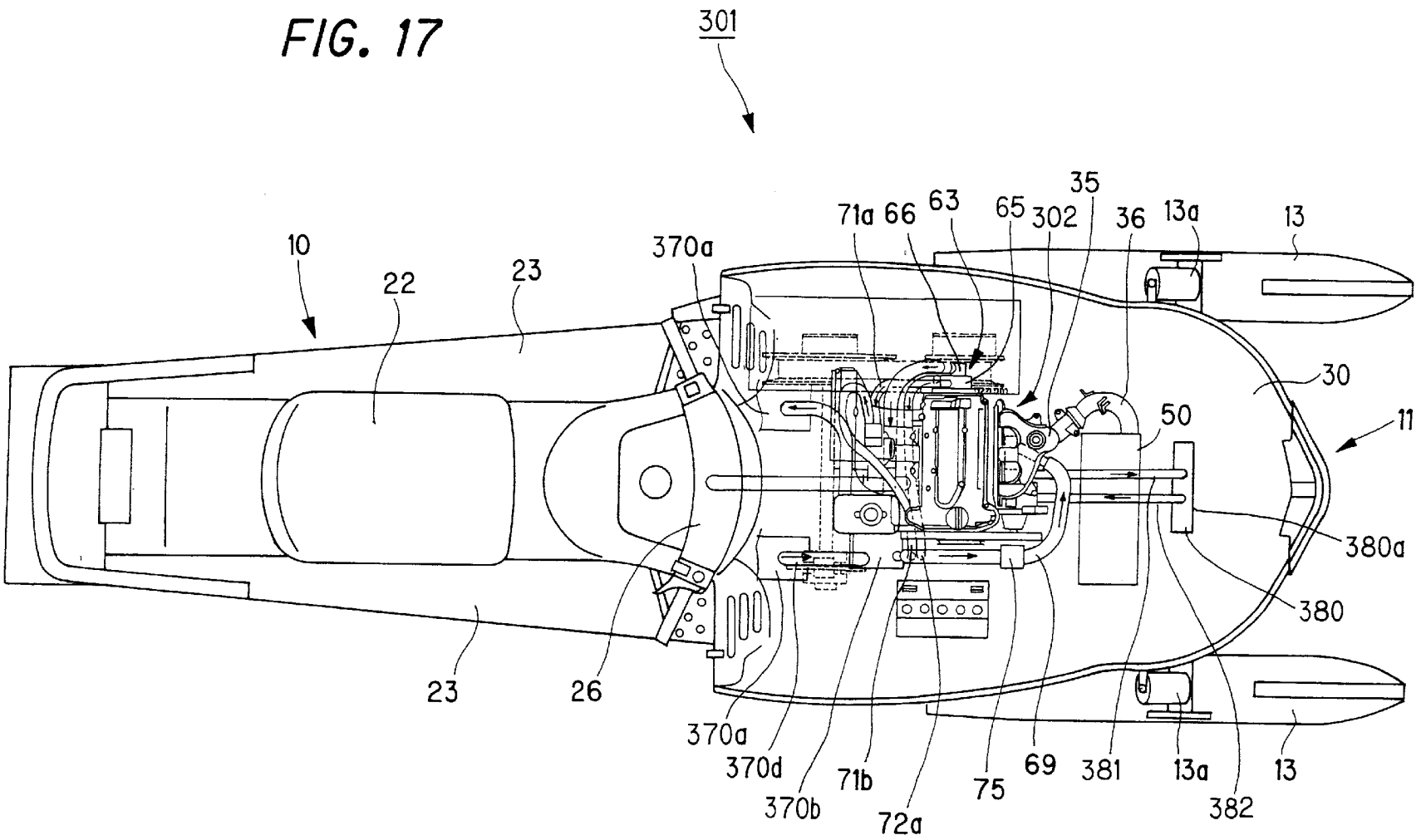
FIG. 17 is a plan view showing the overall configuration of the snowmobile.
Figure 18:
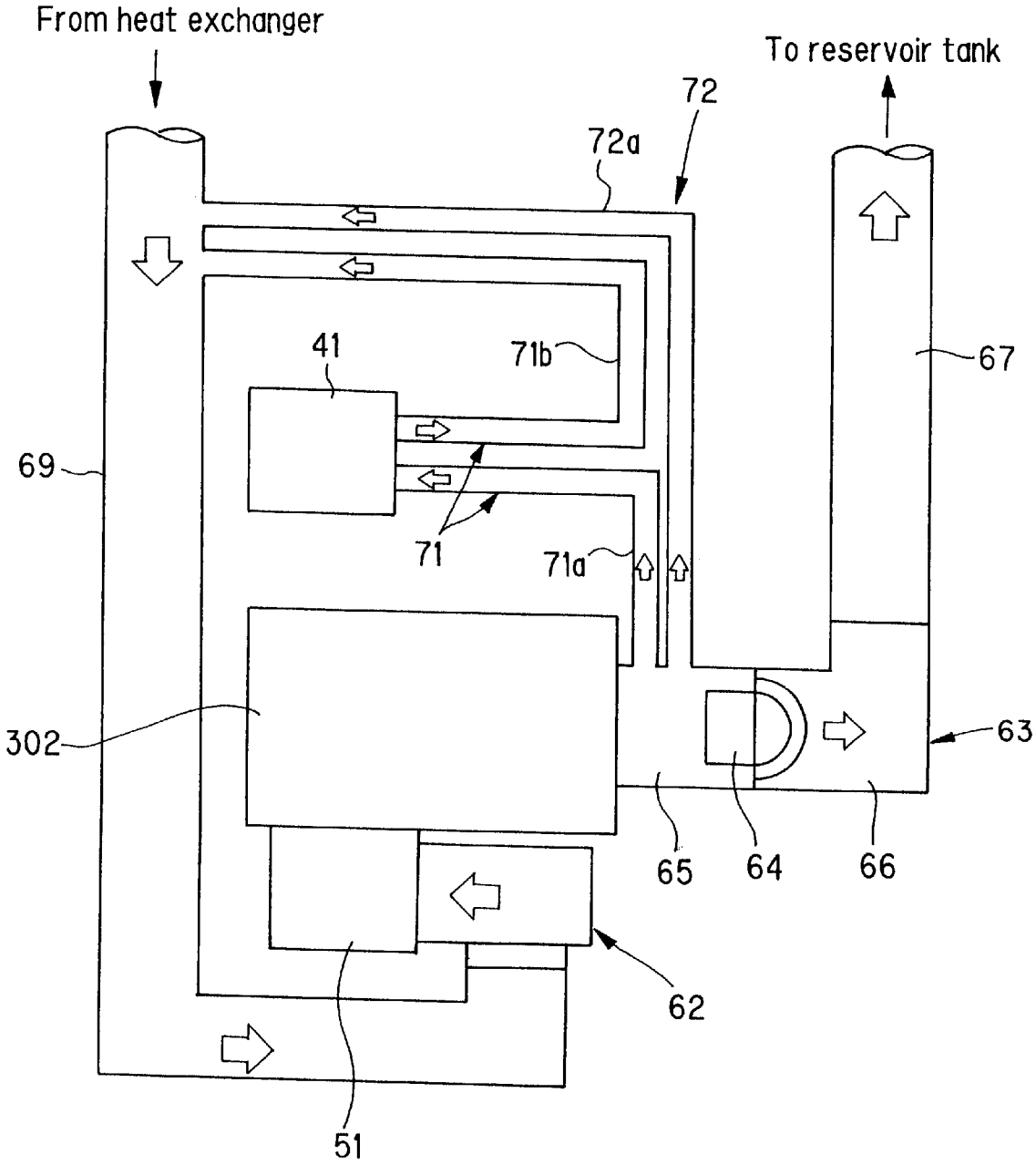
FIG. 18 is an illustrative view schematically showing a cooling arrangement of the engine.

FIGS. 16 to 18 show the third variational example of the above embodiment. In the drawings, components allotted with the same reference numerals as those in the above embodiment should be understood to represent the same components as shown therein.

As shown in FIGS. 16 and 17, in the third variational example, a muffler 50 is disposed in front of the engine body in an engine room 30 of a snowmobile 301 and an oil cooler as an oil cooling means is disposed in front of the muffler 50.

A cooling water inlet port 62 for leading cooling water into a cooling water jacket (not shown) inside the engine is projectively formed in front, with respect to the vehicle's direction of travel, of the cylinder block 3 of engine 302, under an exhaust manifold 35, at a position close to drive belt 52.

A cooling water outlet port 63 through which cooling water is taken out from the cooling water jacket is projectively formed at an upper position on the side face, the side opposite to the drive belt side, of a cylinder head 4 provided on the top of the cylinder block 3.

As shown in FIG. 15, a thermo housing 65 incorporating a thermostat 64 for regulating the flow of cooling water in accordance with the cooling water temperature and a thermo cap 66 for covering the thermostat 64 are provided in cooling water outlet port 63.

In engine room 30, a heat exchanger 370*a* for cooling water is provided under the front part of the rear frame 12 and over the front part, with respect to the vehicle's direction of travel, of a crawler 16, so as to oppose, in an approximately parallel fashion, a track belt 15. Another heat exchanger 370*b* for cooling water is arranged in front of the front side, with respect to the vehicle's direction of travel, of crawler 16, in such a manner that it opposes track belt 15 with its upper side slightly tilted rearwards. Further, an oil cooler 380 for cooling oil is provided in the front side of a muffler 50 disposed in front of engine 302 which is arranged at the approximate center of engine room 30.

The oil cooler 380 has a rectangular shape when placed flat, and is arranged upright with the flat portion, i.e., its cooling portion 380*a* facing frontwards with respect to the vehicle's direction of travel.

This thermo cap 66 is connected to a reservoir tank 60 through a cooling water hose 67 so that the cooling water from the inside of the engine returns to the reservoir tank 60.

The reservoir tank 60 is connected to the aforementioned heat exchanger 370*a* via a cooling water hose 68. The heat exchangers 370*a* and 370*b* are connected by a connecting hose 370*d*. Heat exchanger 370*b* is connected to cooling water inlet port 62 formed on the engine 302 side, by way of a cooling water hose 69. Arranged at an approximately halfway position along cooling water hose 69 is a block heater 75 which covers part of the outer periphery of the hose so as to partially heat the cooling water.

As shown in FIG. 18, the thermo housing 65 is formed with a first cooling water bypass passage 71 which branches off at a point upstream, with respect to the flow of cooling water, of thermostat 64 and is connected by way of throttle body 41 to cooling water hose 69 at a point upstream of water pump 51 and a second cooling water bypass passage 72 which branches off at a point upstream of thermostat 64 and is connected directly to cooling water hose 69 at a point upstream of water pump 51 without passing through the throttle body 41.

The first cooling water bypass passage 71 is composed of a first cooling water bypass hose 71*a* which is connected at its one end to the point upstream, with respect to the flow of cooling water, of thermostat 64 of the thermo housing 65 and connected at the other end to the inlet to the cooling water passage (not shown) formed inside throttle body 41 and another first cooling water bypass hose 71*b* which is connected at its one end to the outlet from the cooling water passage formed inside throttle body 41 and connected at the other end to cooling water hose 69 at a point upstream of water pump 51.

The second cooling water bypass passage 72 is composed of a second cooling water bypass hose 72*a* which is connected at its one end to the point upstream, with respect to the flow of cooling water, of the thermostat of the thermo housing 65 and connected at the other end to cooling water hose 69 at a point upstream of water pump 51.

This first cooling water bypass passage 71 and second cooling water bypass passage 72 are adapted to constantly keep communication between the thermo housing 65 side and the cooling water hose 69 side.

The above-mentioned thermo cap 66 is connected to a reservoir tank 60 through a cooling water hose 67 so that the cooling water from the inside of the engine returns to the reservoir tank 60.

The oil cooler 380 has an oil inlet port to which an oil inlet hose 381 from an oil pump (not shown) is connected and an oil outlet port from which an oil outlet hose 382 is connected to an oil filter 54, so that oil is cooled whilst passing through the oil passage formed inside the oil cooler.

Since this arrangement allows oil cooler 380 to receive the cold flow of air, during travel, ahead of muffler 50 and exhaust pipe 36 which are higher in temperature than the oil cooler, it is possible to cool the oil at an improved efficiency.

As has been described heretofore, according to the cooling arrangement for a snowmobile engine of the present invention, it is possible to stabilize the engine idling speed at the start of operation. This arrangement also brings excellent improvements in the work performance of supplying cooling water whilst realizing a space-saving engine layout.

Detailedly, in accordance with the cooling arrangement for a snowmobile engine, since the water pump is arranged in front, with respect to the vehicle's direction of travel, of the cylinder block of the engine, under the exhaust manifold and since the water pump is driven by the rotational force which is transmitted through the drive belt from the drive pulley engaged to one end of the crankshaft projected, with respect to the direction of the vehicle width, from one side-wall of the cylinder block, no drive source dedicated for the water pump is needed, hence it is possible to realize a save-saving engine layout.

Further, since the cooling water inlet port for leading cooling water into the cooling water jacket inside the engine is formed at a position close to the drive belt on the front side, with respect to the vehicle's direction of travel, of the cylinder block, under the exhaust manifold while the cooling water outlet port through which cooling water is taken out from the engine is formed at a position, close to the side opposite to the drive belt, on the side face of the engine, the cooling water flows through the engine interior, approximately diagonally from the bottom to the top, hence the water is able to efficiently flow without stagnation inside the cylinder head and inside the cylinder block. Thus, this configuration provides an engine of an improved cooling efficiency compared to the conventional configuration. Since supply and discharge of cooling water is achieved utilizing the dead space near the water pump and under the exhaust manifold, this arrangement is effective in providing an engine of a highly efficient space usage.

Finally, since a cooling water bypass for connecting the thermo housing at a position upstream, with respect to the cooling water flowing direction, of the thermostat, with a position upstream, with respect to the cooling water flowing direction, of the water pump is provided, it is possible to establish constant fluid communication through the cooling water bypass passage so that the cooling water warmed by the engine is directly returned to the engine without passing through the heat exchanger. This makes it possible to regulate the temperature of the cooling water in the engine at an approximately constant level under the thermostat control of supply of the cooling water cooled through the heat exchanger. As a result, this configuration provides excellent effects, that is, the thermostat for opening and closing the main cooling water passage in response to the cooling water temperature quickly reacts to the cooling water temperature that varies dependent on the operational state of the engine, to thereby prevent the occurrence of engine seizure and other troubles whilst stabilizing the engine idling speed at the start of operation.

What is claimed is:

1. A cooling arrangement for a snowmobile engine, comprising:

a cooling water jacket formed inside an engine;

a heat exchanger for cooling water;

a water pump for ejecting cooling water; and a thermostat for controlling supply of the cooling water ejected from the water pump into the engine, so as to cool the engine by circulating the cooling water inside the engine, characterized in that:

the engine is mounted with its cylinder head at top, and an exhaust manifold is disposed on the front side, with respect to the vehicle's direction of travel, of the cylinder head while an intake manifold is disposed on the rear side, with respect to the vehicle's direction of travel, of the cylinder head;

the water pump is disposed on the front side, with respect to the vehicle's direction of travel, of cylinder block of the engine, under the exhaust manifold and is coupled to a crankshaft projected from one side wall, with respect to the widthwise direction of the body, of the cylinder block, so that it is driven by the rotational force which is transmitted through a drive belt from a rotational member fitted on one end of the crankshaft;

a cooling water inlet port for leading cooling water into the cooling water jacket inside the engine is provided on the front side, with respect to the vehicle's direction of travel, of the cylinder block and under the exhaust manifold at a position close to the drive belt;

a cooling water outlet port through which cooling water is taken out from the interior of the engine is arranged on the engine's side face at a position over and opposite to the drive belt; and the thermostat is arranged at the cooling water outlet port, at a position downstream with respect to the flow of cooling water.

2. The cooling arrangement for a snowmobile engine according to claim 1, wherein the cooling water outlet port is comprised of a thermo housing for incorporating the thermostat and a thermo cap for covering the thermostat, the thermo cap being connected to the heat exchanger by way of a cooling water passage.

3. The cooling arrangement for a snowmobile engine according to claim 2, wherein the thermo housing is formed with a first cooling water bypass passage which branches off at a point upstream, with respect to the flow of cooling water, of the thermostat and is connected by way of a throttle body to the cooling water passage at a point upstream of the water pump.

4. The cooling arrangement for a snowmobile engine according to claim 2, wherein the thermo housing is formed with a second cooling water bypass passage which branches off at a point upstream of the thermostat and is connected directly to the cooling water passage at a point upstream of the water pump without passing through the throttle body.

5. The cooling arrangement for a snowmobile engine according to claim 3, wherein the thermostat is used to control the outlet of cooling water after passage of the cooling water jacket inside the engine while the thermo housing side and cooling water passage side are kept so as to be in constant communication to each other through the first cooling water bypass passage and the second cooling water bypass passage.

6. The cooling arrangement for a snowmobile engine according to claim 4, wherein the thermostat is used to control the outlet of cooling water after passage of the cooling water jacket inside the engine while the thermo housing side and cooling water passage side are kept so as to be in constant communication to each other through the first cooling water bypass passage and the second cooling water bypass passage.

7. The cooling arrangement for a snowmobile engine according to claim 1, wherein, in the snowmobile, an oil filter is arranged on the front side, with respect to the vehicle's direction of travel, of the cylinder block and an oil cooling means is interposed between the oil filter and the cylinder block.

8. The cooling arrangement for a snowmobile engine according to claim 1, wherein, in the snowmobile, an oil cooling means is provided on the front side, with respect to the vehicle's direction of travel, of a crawler for causing the snowmobile to move.

9. The cooling arrangement for a snowmobile engine according to claim 1, wherein, in the snowmobile, a muffler is disposed in front of the engine body in the engine room and an oil cooling means is arranged in front of the muffler.

10. The cooling arrangement for a snowmobile engine according to claim 1, wherein the water pump is arranged between the engine and the exhaust passage provided in front of the engine.

11. The cooling arrangement for a snowmobile engine according to claim 1, wherein the water pump is arranged over an oil pan.

12. The cooling arrangement for a snowmobile engine according to claim 1, wherein the water pump is arranged under the exhaust manifold.

13. The cooling arrangement for a snowmobile engine according to claim 1, wherein the engine has an alternator provided at a position opposite the water pump with the cylinder block in between, the three components being laid from the front to rear with respect to the vehicle's direction of travel.

14. The cooling arrangement for a snowmobile engine according to claim 1, wherein a cooling water reservoir tank is arranged in the rear of the engine, at the side of the intake manifold, over an oil pan, heat exchanger and alternator.

15. The cooling arrangement for a snowmobile engine according to claim 1, wherein a cooling water reservoir tank is arranged without being projected outwards beyond a drive belt for driving an alternator and water pump, when viewed from top.

* * * * *